US006739415B2

(12) United States Patent
Mitchell et al.

(10) Patent No.: US 6,739,415 B2
(45) Date of Patent: May 25, 2004

(54) DRILL PIPE PROTECTOR

(75) Inventors: Brian Mitchell, Oceanside, CA (US); Andrew Dale Fuller, Redondo Beach, CA (US); Norman Bruce Moore, Aliso Viejo, CA (US)

(73) Assignee: Western Well Tool, Inc., Houston, TX (US)

( * ) Notice: Subject to any disclaimer, the term of this patent is extended or adjusted under 35 U.S.C. 154(b) by 0 days.

(21) Appl. No.: 10/407,093

(22) Filed: Apr. 4, 2003

(65) Prior Publication Data

US 2003/0192720 A1 Oct. 16, 2003

Related U.S. Application Data

(60) Continuation-in-part of application No. 10/082,943, filed on Feb. 26, 2002, now abandoned, which is a continuation of application No. 09/805,612, filed on Mar. 13, 2001, now Pat. No. 6,378,633, which is a division of application No. 09/473,782, filed on Dec. 29, 1999, now Pat. No. 6,250,405.

(60) Provisional application No. 60/114,875, filed on Jan. 6, 1999.

(51) Int. Cl.[7] ..... E21B 17/10

(52) U.S. Cl. ..... 175/325.5; 166/241.6

(58) Field of Search ..... 166/241.1, 241.2, 166/241.7, 241.4–241.6; 175/57, 65, 325.1, 325.5, 325.6, 320

(56) References Cited

U.S. PATENT DOCUMENTS

| | | | |
|---|---|---|---|
| 1,903,467 | A | 4/1933 | MacClatchie |
| 2,281,632 | A | 5/1942 | Steps |
| 2,318,878 | A | 5/1943 | Miller |
| 2,657,956 | A | 11/1953 | Hall, Sr. |
| 2,715,552 | A | 8/1955 | Lane |
| 2,739,018 | A | 3/1956 | Collett |
| 2,776,111 | A | 1/1957 | Vance |
| 3,103,391 | A | 9/1963 | Leathers |
| 3,292,705 | A | 12/1966 | Hall, Sr. |
| 3,410,613 | A | 11/1968 | Kuus |
| 3,528,499 | A | 9/1970 | Collett |
| 3,675,728 | A | 7/1972 | Faulk et al. |
| 3,982,594 | A | 9/1976 | Berthiaume |
| 4,043,410 | A | 8/1977 | Bennett et al. |
| 4,083,612 | A | 4/1978 | Olson |
| 4,199,853 | A | 4/1980 | Fricker |
| 4,266,578 | A | 5/1981 | Swain et al. |
| 4,361,193 | A | 11/1982 | Gravley |
| 4,398,772 | A | 8/1983 | Odell |
| 4,428,441 | A | 1/1984 | Dellinger |
| 4,467,879 | A | 8/1984 | Burge |
| 4,543,998 | A | 10/1985 | Thomerson |
| 4,601,334 | A | 7/1986 | Lovegrove |
| 4,630,691 | A | 12/1986 | Hooper |
| 4,690,229 | A | 9/1987 | Raney |
| 4,708,203 | A | 11/1987 | Walker |
| 4,709,462 | A | 12/1987 | Perkin et al. |
| 4,796,670 | A | 1/1989 | Russell et al. |
| 4,823,891 | A | 4/1989 | Hommani et al. |
| 4,842,083 | A | 6/1989 | Raney |
| 4,984,633 | A | 1/1991 | Langer et al. |
| 5,069,284 | A | 12/1991 | Gray |
| 5,069,297 | A | 12/1991 | Krueger, deceased et al. |
| 5,542,454 | A | 8/1996 | Carlson et al. |
| 5,803,193 | A | 9/1998 | Krueger et al. |
| 5,833,018 | A | 11/1998 | von Gynz-Rekowski |
| 5,901,798 | A | 5/1999 | Herrera et al. |

FOREIGN PATENT DOCUMENTS

| | | |
|---|---|---|
| GB | 2083102 | 3/1982 |
| WO | WO 95/10685 | 4/1995 |

*Primary Examiner*—Robert E. Pezzuto
(74) *Attorney, Agent, or Firm*—Christie, Parker & Hale LLP

(57) ABSTRACT

A drill pipe protector having a tubular sleeve that is attached to a section of drill pipe and resides over the outer diameter of the drill pipe while moving within an associated well casing or well hole. The sleeve has low-friction end pads positioned on the ends of the sleeve to reduce friction between the ends of the sleeve and the end of an adjacent thrust bearing collar used to hold the sleeve in place on the drill pipe.

40 Claims, 14 Drawing Sheets

DRILL PIPE PROTECTOR

CROSS-REFERENCE TO RELATED APPLICATION(S)

This application is a continuation-in-part application of application Ser. No. 10/082,943, filed Feb. 26, 2002, now abandoned, which is a continuation of application Ser. No. 09/805,612, filed Mar. 13, 2001, now U.S. Pat. No. 6,378,633, which is a divisional application of application Ser. No. 09/473,782 filed Dec. 29, 1999, now U.S. Pat. No. 6,250,405, which claims priority from U.S. Provisional Application No. 60/114,875 filed Jan. 6, 1999.

FIELD OF THE INVENTION

This invention relates generally to non-rotating drill pipe protectors attached to a drill string, and more particularly, to improved low-friction drill pipe protectors by incorporating a soft elastomer liner and low-friction end pads.

BACKGROUND OF THE INVENTION

The drilling of holes or bores into underground formations and particularly, the drilling of oil and gas wells, is typically accomplished using a drill bit which is attached to the lower end of an elongated drill string. The drill string is constructed from a number of sections of tubular drill pipe which are coupled at their ends to form the "drill string". The drill string extends from the drilling surface into a well or "wellbore" which is formed by the rotating drill bit. As the drill bit penetrates deeper or further into an underground formation, additional sections of drill pipe are added to the drill string.

Casing is generally installed in the wellbore from the drilling surface to various depths. The casing lines the wellbore to prevent the wall of the wellbore from caving in and to prevent seepage of fluids from the surrounding formations from entering the wellbore. The casing also provides a means for recovering the petroleum if the well is found to be productive.

A drill string is relatively flexible, being subject to lateral deflection, especially at the regions between joints or couplings. In particular, the application of weight onto the drill string or resistance from the drill bit can cause axial forces which in turn can cause lateral deflections. These deflections can result in portions of the drill string contacting the casing or wellbore. In addition, the drilling operation may be along a curved or angled path, commonly known as "directional drilling." Directional drilling also causes potential contact between portions of the drill string and the casing or well bore.

Contact between the drill string and the casing and well bore creates frictional torque and drag. In fact, a considerable amount of torque can be produced by the effects of frictional forces developed between the rotating drill pipe and the casing or the wall of the well bore. During drilling operations, additional torque is required while rotating the drill string to overcome this resistance. In addition, the drill string is subjected to increased shock and abrasion whenever the drill string comes into contact with the wall of the well bore or, where lined, the casing. Drilling tools and associated drill string devices encounter similar problems.

To alleviate these problems, drill pipe protectors are typically spaced apart along the length of the drill pipe. These drill pipe protectors were originally made from sleeves of rubber or other elastomeric material which were placed over the drill pipe to keep the drill pipe and its connections away from the walls of the casing and/or formation. Rubber or other elastomeric materials were used because of their ability to absorb shock and impart minimal wear.

Previously available drill pipe protectors have an outside diameter (O.D.) greater than that of the drill pipe joints, and were installed or clamped rigidly onto the drill pipe at a point near the joint connections of each length of drill pipe. The O.D. is specifically sized to be larger than the tool joint, but not too large as to restrict returning fluids which could result in "pistoning" of the protector in the hole. Such an installation allows the protector only to rub against the inside wall of the casing as the drill pipe rotates. Although wear protection for the casing is the paramount objective when using such drill pipe protectors, they can produce a significant increase in the rotary torque developed during drilling operations. In instances where there may be hundreds of these protectors in the wellbore at any one time, they can generate sufficient accumulative torque or drag to adversely affect drilling operations if the power required to rotate the drill pipe approaches or exceeds the supply power available.

In response to the problems of wear protection and torque build up, improvements have been directed toward producing drill pipe/casing protectors from various low-friction materials in different configurations. However, such an approach again has only been marginally effective, and oil companies still are in need of an effective means to greatly reduce the wear and frictionally-developed torque normally experienced particularly when drilling deeper wells and deviated wells.

U.S. Pat. No. 5,069,297 to Krueger, et al., assigned to the assignee of the present application, and incorporated herein by reference, discloses a drill pipe/casing protector assembly which has successfully addressed the problems of providing wear protection for the casing and reduced torque build up caused by the drill pipe protectors during drilling operations. The protector sleeve in the '297 patent rotates with the drill pipe during normal operations in which there is an absence of contact between the protector sleeve and the casing, but the protector sleeve stops rotating, or rotates very slowly, while allowing the drill pipe to continue rotating within the sleeve unabated upon frictional contact between the sleeve and the casing. Thrust bearings are rigidly affixed to the drill pipe at opposite ends of the protector sleeve, and these, in combination with the internal configuration of the protector sleeve, produce a fluid bearing effect in the space between the inside of the sleeve and the outside of the drill pipe. The fluid bearing effect is produced by circulating drilling fluid through the space between the sleeve and the drill pipe so that it reduces frictional drag between the rotating drill pipe and the sleeve when the sleeve stops rotating from contact with the casing.

U.S. Pat. No. 5,803,193, to Krueger, et al., assigned to the assignee of the present application, and incorporated herein in its entirety by reference, discloses a drill pipe/casing protector assembly which provides an enhanced fluid bearing effect that reduces frictional drag between the rotating drill string and the protector sleeve during use.

Although modern drill string protector designs have improved the lubrication and protection of both the drill string and the casing, there is still a need for improved sliding lubrication. In addition, there is a need for hydraulic lift to overcome the heavy normal forces and torques encountered by the operating drill string. This problem is especially significant in extended reach drilling. In long holes and as depth increases, the friction of the drill string against the hole wall increases resulting in difficulty in putting weight on the drill bit or a tendency for the weight to surge forward then reduce in a "stickion" type process. Thus, a drill pipe protector that both reduces the torque from the drill string and increases the sliding ability of the drill string against the casing is highly desirable.

Another problem to which the present invention is directed is the reduction of friction between the protector sleeve and the thrust bearings or collars positioned on either end of the sleeve. Improvements in economic value through increased product life without loss of structural integrity is also desirable.

SUMMARY OF THE INVENTION

The present invention overcomes the aforementioned problems by providing in one embodiment a drill pipe protector assembly that provides hydraulic lift and improved sliding lubrication to a drill string. The creation of hydraulic lift and forced lubrication reduces wear on the protector and on the casing or well wall as well as reducing sliding friction of the drill pipe/protector combination relative to the casing or well wall.

By providing a drill pipe protector assembly having a fluid pathway which directs a portion of the drilling mud moving through the annular space between the drill pipe protector and the drill pipe to the annular space between the protector and the casing or outer well wall, hydraulic lift is created and sliding lubrication is achieved. By providing shaped channels along the longitudinal length of the outer surface of the protector, increased hydraulic lift is developed.

In one embodiment, the present invention is generally directed to a drill pipe protector which defines a tubular sleeve that fits over the drill pipe. The sleeve is attached to a section of drill pipe and resides over the drill pipe. The sleeve is positioned between the outer diameter of the drill pipe and an associated well casing or well hole. The sleeve is adapted to provide hydraulic lift and lubrication relative to the well casing and thus, increase the proclivity of the drill pipe to slide down the hole while also reducing the development of cutting dams.

More specifically, the drill pipe protector assembly comprises a tubular body having an inner surface and an outer surface and extends along a longitudinal axis between a first end and a second end. The tubular body is adapted to be deployable about the outside of a drill string and within the wellbore or casing. A channel is formed on the outer surface of the body and extends substantially along the longitudinal axis from the first end to the second end. The channel directs the flow of drilling fluid between the outer surface and the inside surface of the casing. An opening extends radially from the inner surface to the outer surface of the tubular body. The opening allows the passage of the drilling fluid from the inner surface to the outer surface.

In this embodiment the protector is a generally cylindrical shaped tubular body having a plurality of spaced apart channels along its outer surface. The outer surface includes a plurality of radially outwardly protruding ridges which extend substantially along the longitudinal axis. The ridges are spaced apart sufficient so as to form the described channels therebetween. At least one, and preferably, all of the channels include an opening which allows the drilling fluid to pass from the inner surface to within the channel.

The sleeve includes a plurality of spaced apart radial openings or diffusor ports which directs a portion of the drilling mud moving longitudinally through the annular space between the inside of the sleeve and drill pipe to the annular space between the outside of the sleeve and the casing or outer well wall. The outside surface of the sleeve also includes a plurality of shaped channels which are in communication with these radial openings. The channels direct the flowing mud to lubricate the outer surface of the sleeve and create hydraulic lift relative to the casing wall.

In another embodiment of the present invention, the drill pipe protector assembly is a tubular sleeve having a plurality of longitudinally extending and radially protruding ridges formed on its outer surface. The ridges or ribs are spaced apart to define channels therebetween and at least some of the channels are configured to define a longitudinally extending channel having a double wedge shape. The double wedge shaped channels form passageways for the longitudinal flow of the drilling mud along the outer surface of the sleeve. Each channel or passageway includes a radially oriented internal passageway that interconnects the drilling fluid passing through the annular space between the sleeve and the drill pipe and the annular space between the outside of the sleeve and the casing. Each double wedge shaped channel defines an increasingly narrower and shallower passageway which transitions to a increasingly wider and deeper passageway along its longitudinal length. The double wedge shape accelerates and then decelerates the flow to create a hydraulic lift relative to the casing wall and also enhance the flow of the drilling mud therebetween.

In another aspect of the present invention, the protector assembly includes a tubular sleeve for use with drill tool assemblies. The sleeve includes channels formed on the outer surface for directing the flow of mud in the annular space between the channels and the casing. In addition, the sleeve includes a plurality of spaced apart radially oriented internal passageways that interconnects the drilling mud passing through the annular space between the sleeve and the drill pipe and the annular space between the outside of the sleeve and the casing.

In another embodiment of the present invention, the protector incorporates low-friction material pads on the external surfaces. The pads are made of Teflon composites. The protector can have a plurality of curved surfaces.

In another embodiment of the present invention, the protector incorporates a multi-stave multi-material sleeve that includes use of a soft elastomeric liner having a preferred hardness of 60 Shore A, although can be in the range of 40–85 Shore A, in a urethane sleeve having a preferred hardness of 95 Shore A, although can be in the range of 75–95 Shore A for urethane, and 75 to 123 Rockwell R for harder plastics. The flexible inner liner material produces a more efficient fluid bearing and thus a lower coefficient of rotational friction between the drill pipe and the sleeve.

Studies have been undertaken to improve the performance of the fluid bearing of a drill pipe protector while providing the same or better strength of previous polyurethane formulations and improving protector assembly economic life. Testing determined that friction losses were manifest between the drill pipe and the protector sleeve on the inside diameter of the sleeve and at the interface between the sleeve and the collar on the ends of the sleeves and collars. The combination of these two sources of friction is the net resultant coefficient of frictional loss per drill pipe protector assembly. Quantification of the rotational frictional loss on the sleeve I.D. and the rotational loss at the interface of the sleeve to the collar varies for different types of materials used for the protector sleeves.

For urethane sleeves with 95 A Shore hardness, approximately 50 to 60% of the total frictional loss comes from the friction between the ends of the sleeve and the collar. The frictional loss between the sleeve I.D. and the drill pipe provides the other significant friction dissipation. The friction between the ends of the sleeve and the collar is the source for the wearing of the ends of the sleeves and, hence, most frequently becomes the factor that limits the useful economic life of the protector sleeves and collars. Therefore, in another embodiment of the present invention, the protector consists of a unique composite sleeve design to reduce frictional forces and wear on the ends of the sleeves and collars without loss of structural integrity. This is accomplished by incorporating low-friction abrasion-resistant end pads integrally molded into the sleeve during the manufacturing process. The end pads are pre-stamped into a preferred configuration wherein the pre-formed low-friction end pad is placed at the bottom of the mold during the manufacturing process. Depending upon the configuration, a metal cage would then be inserted before the urethane is poured into the mold. Low-friction end pads can be positioned at one or both ends of the protector sleeve during the manufacturing process. Alternatively, multiple segments of low-friction abrasion resistant end pads can be positioned at the end of the sleeve, which are placed at the bottom of the mold before the urethane is poured.

These and other features and advantages of the invention will be apparent and more fully understood by those of skill in the art by referring to the following detailed description of the preferred embodiments which is made in reference to the accompanying drawings, a brief description of which is provided below.

DETAILED DESCRIPTION OF THE INVENTION

Figure 1:
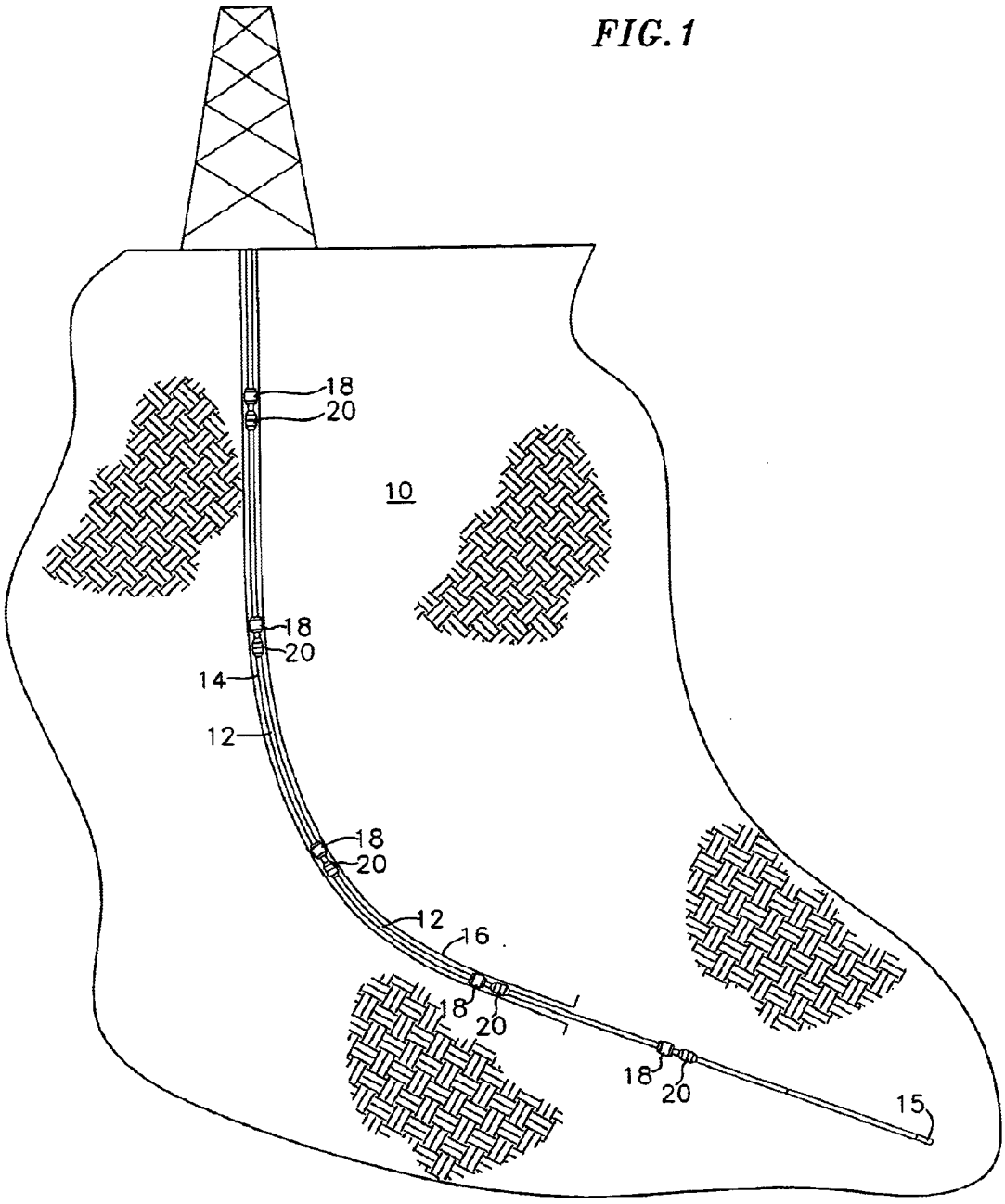
FIG. 1 is a schematic side elevational view, partly in cross-section, showing a string of drill pipe having drill pipe/casing protector assemblies according to this invention installed between tool joints of the drill pipe in a deviated well being drilled in an underground formation.

FIG. 1 illustrates a well drilling system for drilling a well in an underground formation 10. A rotary drill string comprises a plurality of elongated tubular drill pipe sections 12 which drill a well bore 14 with a drilling tool 15 installed at the bottom of the drill string. An elongated cylindrical tubular casing 16 can be cemented in the well bore to isolate and/or support formations around the bore. The invention is depicted in a deviated well which is drilled initially along a somewhat straight path and then curves near the bottom and to the side in a dog leg fashion. It is the drilling of wells of this type that can substantially increase the torque applied to the drill string during use, and where the present invention, by reducing the amount of torque build up, makes it possible to drill such deviated wells to greater depths and to drill them more efficiently while preventing damage to the casing and drill pipe.

The invention is further described herein with respect to its use inside a casing in a well bore, but the invention also can be used to protect the drill pipe from damage caused by contact with the wall of a bore that does not have a casing. Therefore, in the description and claims to follow, where references are made to contact with the wall or inside diameter (I.D.) of a casing, the description also applies to contact with the wall of the well bore, and where references are made to contact with a bore, the bore can be the wall of a well bore or the I.D. of a casing.

As illustrated, separate longitudinally spaced apart drill pipe protector assemblies 18 are mounted along the length of a drill string to protect the casing from damage that can occur when rotating the drill pipe inside the casing. The sections of the drill pipe are connected together in the drill string by separate drill pipe tool joints 20 which are conventional in the art. The drill pipe can produce both torque and drill pipe casing wear and resistance to sliding of the drill string in the hole. The separate drill pipe protectors 18 are mounted to the drill string 12 adjacent to each of the tool joints to reduce drill string torque, reduce sliding friction forces, reduce shock and vibration to the drill string and abrasion to the inside wall of the casing.

When the drill pipe is rotated inside the casing, its tool joints would normally be the first to rub against the inside of the casing, and this rubbing action will tend to wear away either the casing, or the outside diameter of the drill pipe, or its tool joints, which can greatly reduce the protection afforded the well or the strength of the drill pipe or its tool joints. To prevent this damage from occurring, the outside diameter of the drill pipe protector sleeve, which is normally made from rubber, plastic (such as nylon) is greater than that of the drill pipe and its tool joints. Such an installation allows the protector sleeve only to rub against the casing. Although they are useful in wear protection, these protectors can generate substantial cumulative torque along the length of the drill pipe, particularly when the hole is deviated from vertical as shown in FIG. 1. This adversely affects drilling operations, primarily by producing friction which reduces the rotation and torque value generated at the surface and which is then translated to the drill bit. The present invention provides a solution to this problem.

Figure 2:
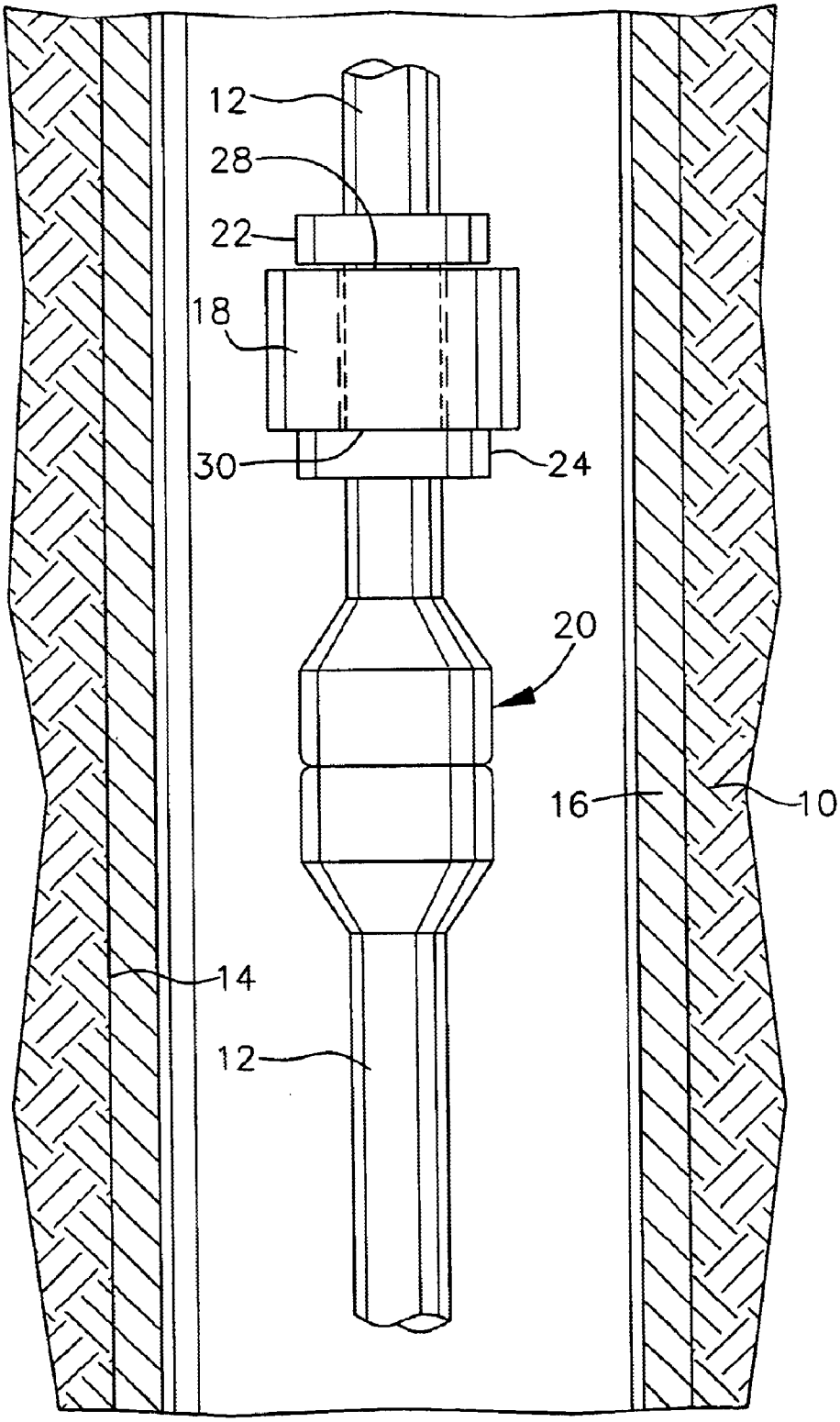
FIG. 2 is a detail view of FIG. 1 illustrating one drill pipe joint and one drill pipe protector.

FIG. 2 further schematically illustrates a drill pipe protector assembly of the present invention. Drill pipe protector or sleeve 18 is sandwiched loosely between upper and lower thrust bearings or collars 22 and 24 which are rigidly affixed to the O.D. of the drill pipe section 12. A small gap exists between the drill pipe protector and the thrust bearings. The drill pipe protector is mounted to the drill pipe using techniques which hold the protector on the drill pipe and which allow the sleeve to normally rotate with the drill pipe during drilling operations; but when the drill pipe protector sleeve comes into contact with the casing 16, the sleeve stops rotating, or at least slows down substantially, while allowing the drill pipe to continue rotating inside the drill pipe protector. This change in point of rotation from the outside diameter, i.e., O.D. of the protector to the O.D. of the drill pipe, in effect, reduces the distance at which the friction associated with drill pipe rotation is applied to the drill pipe.

Hydrolift Type Drill Pipe Protector

Figure 3A:
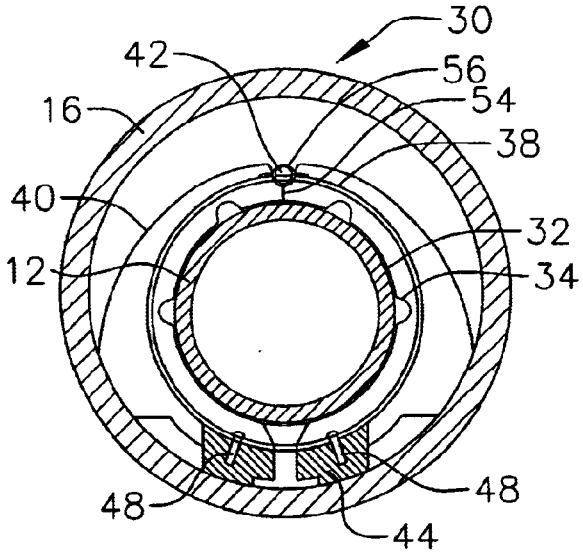
FIG. 3A is a front cross-sectional view of a first embodiment of a hydrolift drill pipe protector assembly constructed according to the principles of the present invention.
Figure 3B:
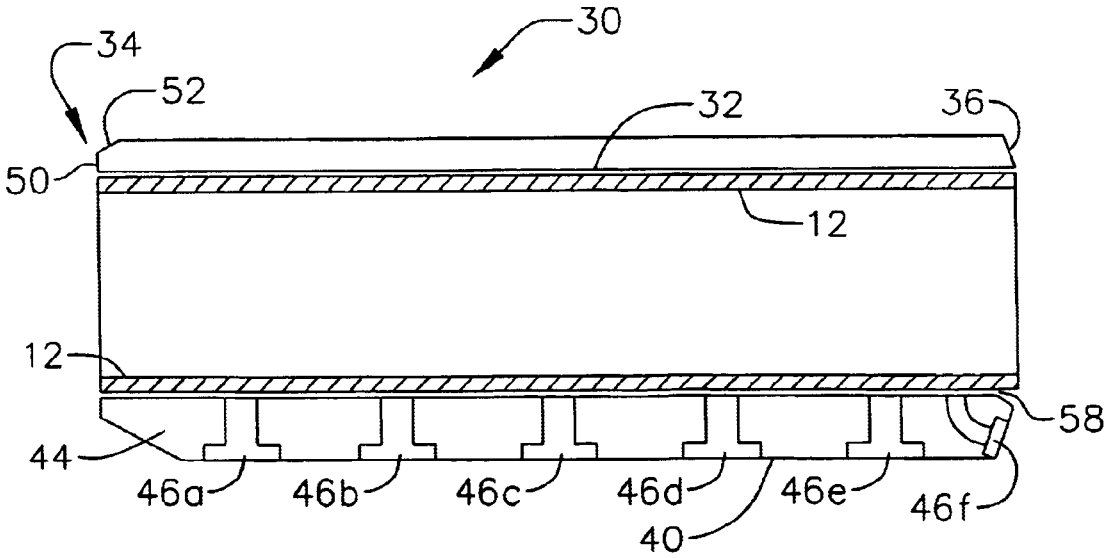
FIG. 3B is a side cross-sectional view of the drill pipe protector assembly of FIG. 3A, showing diffuser exit ports.

Referring now to FIGS. 3A and 3B, a hydrolift type non-rotating drill pipe protector 30 is shown.

The hydrolift non-rotating drill pipe protector 30 comprises an elongated tubular sleeve made from a suitable protective material, such as, a low coefficient of friction, polymeric material, metal or rubber material. A presently preferred material is a high density polyurethane or rubber material. The sleeve has an inside diameter (I.D.) 32 in a generally circular configuration. The I.D. further includes a plurality of elongated longitudinally extending, straight, parallel axial grooves 34 spaced apart circumferentially around the I.D. of the sleeve. The grooves are open ended in the sense that they open through an annular first end 34 and annular opposite second end 36 of the sleeve.

The inside wall of the sleeve is divided into intervening wall sections between adjacent pairs of the grooves 34. Each wall section has an inside bearing surface. For polyurethane or rubber sleeves, a metal reinforcement cage 38 is embedded within the sleeve between the I.D. wall 32 and the outer diameter (O.D.) wall 40. The metal reinforcing cage 38 has a retainer hinge 42 for attaching the protector 30 to the drill pipe 12. In the embodiment shown in FIGS. 3A and 3B the wall thickness of the protector 30 varies between the I.D. and the O.D. so that the protector is egg shaped in cross section. Located at the base of the egg shaped protector is a diffuser 44. The diffuser 44 has a plurality of exit ports 46*a*–46*f* which, with the exception of port 46*f*, extend from the I.D. 32 to the O.D. 40. The diffuser 44 can be rigidly connected to cage 38 by fasteners 48 or alternatively can be integrally molded into the sleeve.

The wall thickness of the protector 30 is such that the drill pipe protector has an O.D. greater than the O.D. of the adjacent drill pipe tool joints 20. The annular first 34 and second 36 edges of the protector sleeve have a configuration that functions to draw fluid between the sleeve and the collar, thereby assisting in the formation of a fluid bearing between the I.D. of the protector and the O.D. of the drill pipe 12. The first edge 34 includes a generally flat annular inside edge section 50 extending horizontally and generally at a right angle to the vertical inside wall of the sleeve. The edge section 50 has a beveled edge section 52 leading to the vertical inside wall to prevent or reduce the wear to the drill pipe brought about by the action of axial forces. The angular section 52 works to reduce wear experienced on the ends of the protector sleeve and the drill pipe when acted upon by heavy axial loading.

The drill pipe protector sleeve 30 is split longitudinally to provide a means for spreading apart opposite sides of the sleeve when mounting the sleeve to the O.D. of the drill pipe. FIG. 3A illustrates a pair of diametrically opposed vertically extending edges 54 that define the ends of a longitudinal split that splits the sleeve into halves. The sleeve is split longitudinally and is fastened by a latch pin 56 which extends through retainer hinge 42. Alternatively, the sleeve halves may be hinged along one side and releasably fastened on an opposite side by a latch pin, or they may be secured along both opposite sides by bolts. The metal cage 38 forms an annular reinforcing ring embedded in the molded body of the sleeve. (A protector sleeve made of metal includes no reinforcing cage). The purpose of the cage is to reinforce the strength of the sleeve. The cage can absorb the compressive, tensile and shear forces experienced by the sleeve when operating in the casing or wellbore. The reinforcing cage can be made from expanded metal, metal sheet stock, or metal strips or composite (fiber). One presently preferred technique is to form the reinforcing member from a steel sheet stock with holes uniformly distributed throughout the sheet.

The confronting top and bottom thrust bearings or collars 22 and 24 as described in FIG. 2 have adjacent annular end surfaces confronting the top and bottom annular end surfaces of the sleeve at essentially the same angular orientations. The upper and lower thrust bearings 22 and 24 are rigidly affixed to the O.D. of the drill pipe above and below the drill pipe protector sleeve. The thrust bearings (also referred to as collars) are metal collars made of a material such as aluminum, bronze alloys or a hard plastic material, such as, composites of glass or graphite fibers in a matrix such as nylon to encircle the drill pipe and project outwardly from the drill pipe. The collars project a sufficient axial distance along the drill pipe to provide a means for retaining the sleeve in an axially affixed position on the drill pipe, restrained between the two thrust bearings. The thrust bearings are rigidly affixed to the drill pipe and rotate with the drill pipe during use. The means for securing the thrust bearings to opposite ends of the sleeve can be similar to fastening means shown in U.S. Pat. No. 5,069,297. The upper and lower thrust bearings are affixed to the drill pipe to provide a very narrow upper working clearance between the bottom of the upper thrust bearing and the annular top edge of the sleeve and a separate lower working clearance between the top of the lower thrust bearing and the bottom annular edge of the sleeve. The lower clearance can be narrow, such as one quarter of an inch or a clearance as much as one inch. The bearings are preferably split and bolted or hinged and bolted with spaced apart cap screws on outer flanges of the collar.

During use, when the rotary drill pipe is rotated within the casing or well, the outer surface of the drill pipe protector sleeve comes into contact with the interior surface of the casing or wellbore. The sleeve, which is normally fixed in place on the drill pipe, rotates with the drill pipe during normal drilling operations. However, under contact with the inside wall of the casing, the sleeve stops rotating, or its rotational speed is greatly reduced, while allowing the drill pipe to continue rotating inside the sleeve. The configuration of the I.D. of the sleeve is such that the drill pipe can continue rotating while the sleeve is nearly stopped or rotating slightly and yet its stoppage exerts minimal frictional drag on the O.D. of the rotating drill pipe. The inside bearing surface of the sleeve, in combination with the axial grooves, induces the circulating drilling mud within the annulus between the casing and the drill pipe to flow under pressure at one end of the sleeve through the parallel grooves to the opposite end of the sleeve. This produces a circulating flow of drilling mud under pressure at the interface of the sleeve and the drill pipe and this fluid becomes forced into the bearing surfaces between the grooves. This deforms or spreads apart the bearing surface regions to produce a pressurized thin film of lubricating fluid between the sleeve I.D. and the drill pipe O.D. which reduces frictional drag between these two surfaces. This action of the lubrication being forced into the region between the sleeve and the drill pipe acts as a fluid bearing to force the two surfaces apart, and such action thereby reduces the friction that would normally be experienced both on the O.D. of the drill pipe and the I.D. of the sleeve due to the fact that a thin film of fluid is separating the two surfaces. Since the fluid separates these two surfaces the torque developed as a result of the rotation is greatly reduced.

In addition the thrust bearings at opposite ends of the sleeves, which retain the sleeves position on the drill part, also assist in producing a further fluid bearing effect at the ends of the sleeve.

As previously stated pressure is generated by the hydraulic bearing formed in the space 58 between the O.D. of the drill pipe and the I.D. of the protector. The pressure is directed to the diffuser exit ports 46*a*–46*f* that delivers fluid to the region between the protector 30 and the internal surface of the casing 16. The pressurized fluid tends to exit the diffuser tending to lift the protector and simultaneously lubricate the interface of the sleeve to the casing. The fluid movement through the exit ports also tends to clean cuttings from the bottom of the hole thus helping to prevent "stuck pipe" conditions. The pressure at which the hydraulic bearing fluid exits the diffuser exit ports can be varied by the speed at which the drill pipe is rotated. For example rotating the pipe more rapidly increases the pressure thus improving sliding and lifting of the drill pipe. The number of exit ports also can be varied to adjust the desired lift. The geometrical configuration of the exit ports 46*a*–46*f* can include circular, rectangular or other specialized shapes. Although the exit ports direct fluid in between the outer surface of the diffuser and the inner surface of the casing, the exit ports can be placed on the ends of the sleeve to direct fluid towards the collar to improve life of the collar through reduced loads and improve lubrication. For example, exit port 46*f* directs fluid towards the collar.

The protector 30 incorporates an egg shaped configuration so that during lateral drilling the diffuser exit ports are always positioned at the bottom of the hole to lift the drill pipe off of the casing.

Figure 4:
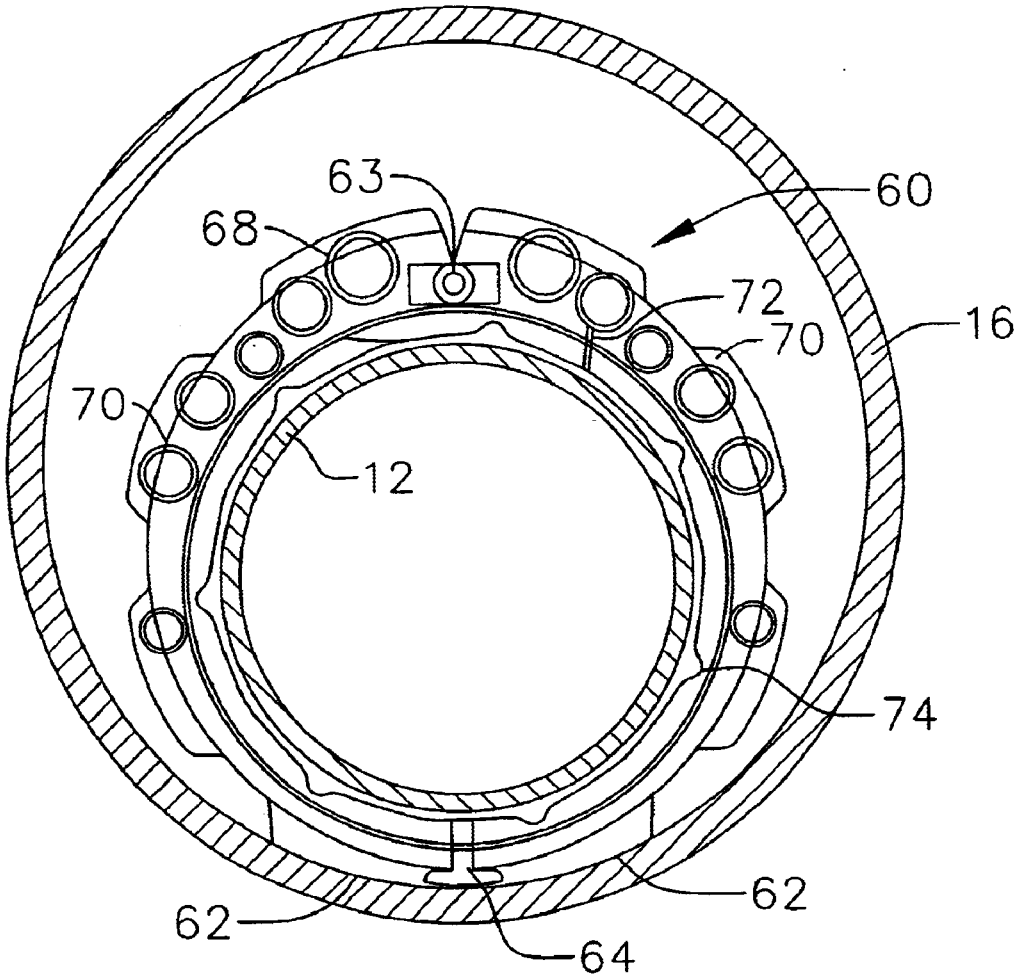
FIG. 4 is a cross-sectional view of an alternative embodiment hydrolift drill pipe protector.
Figure 5A:
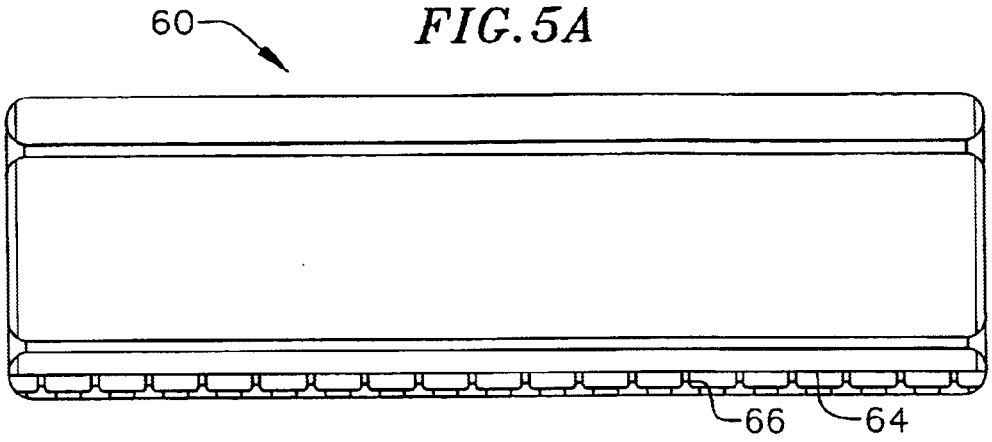
FIG. 5A is a side view of the protector of FIG. 4.
Figure 5B:
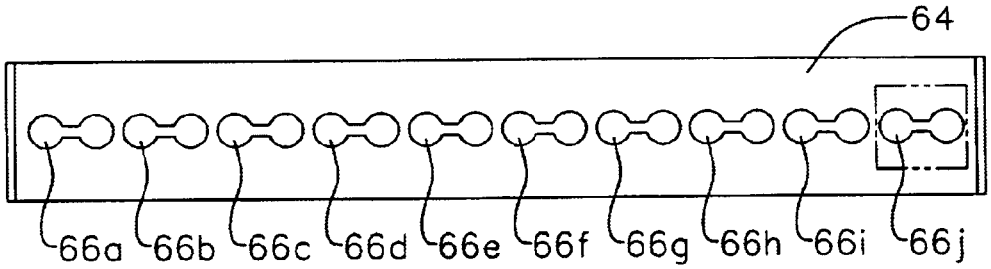
FIG. 5B is a cross-sectional view of the diffuser of FIG. 5A.

An alternative embodiment hydrolift non-rotating drill pipe protector 60 is shown in FIGS. 4 and 5. In this embodiment, protector 60 is eccentric relative to the drill pipe 12 resulting in less wall thickness near wear pads 62 and a greater wall thickness at the region near the retainer hinge 63. This configuration results in a self-positioning of the diffuser 64 at the lowest portion of the casing 16. Having a thinner area opposite the hinge 63 also facilitates in opening of the sleeve for installation onto the pipe. The region near the hydrolift exit ports 66*a*–66*j* thus substantially becomes the portion of the protector that interfaces with the casing. In this embodiment the thinner diffuser portion can be made from low-friction material to improve sliding or alternatively the entire protector can be made from a low-friction material such as Rulon (Tellon and bronze composite).

The protector 60 has two types of reinforcements, a metal reinforcement cage 68 and reinforcement tubes 70. The reinforcement tubes can run the entire length of the protector or only portions of its length. The reinforcement tubes may be open to the drilling mud to aid in returning the mud to the annulus between the protector and the casing. Alternatively, a portion of the drilling mud in the reinforcement tubes can be redirected through feeder tubes 72 to the bearing surface between the I.D. of the protector and the O.D. of the drill pipe, thus replenishing regions of the sleeve that deplete fluid through the hydrolift exit ports. The tubes can be a simple void, or lined with tubing of various types such as aluminum or composite tubing. When the reinforcement tubes are properly spaced i.e. 20–80% of cross-sectional area, the resulting composite sleeve has enhanced bearing resistance. Protector 60 has an I.D. configuration similar to protector 30 which creates a hydraulic bearing is created by drilling mud moving between the sleeve and the fluid bearing surface as discussed with respect to protector 30. A hydraulic bearing is created by drilling mud moving between the I.D. of the sleeve and the O.D. of the drill pipe by drilling mud flowing through the axial grooves 74 on the I.D. of the protector or feeder lines 72 from reinforcement tubes 70.

Figure 6:
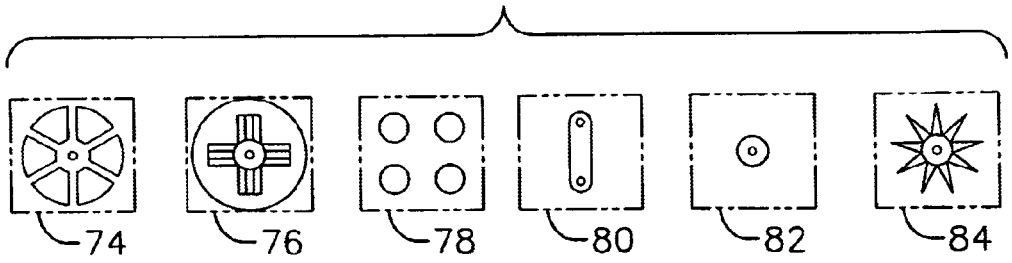
FIG. 6 is a detail view showing different cross-sectional configurations of the diffuser ports.

The placement of the diffuser 64 and exit ports 66*a*–66*j* is to allow the continuous operation of the hydraulic bearing as well as the operation of the diffuser. It is this combination which provides the benefits of reduced drilling torque and reduced sliding resistance. The hydrolift bearings can also be placed on the ends of the sleeve, pressurized by the thrust bearings, thus providing additional lubrication as well as some lift-off from the collar thus increasing the wear life of the ends of the sleeve. Numerous configurations of hydrolift diffuser and exit port configurations are possible as shown in FIG. 6., but is not limited to these configurations, as someone skilled in the art would know. Configurations 74 and 76 are based upon a thrust bearing principle whereas configurations 78–84 are designed to primarily offer improved lubrication.

TABLE 1

HydroLift Design Computations

| Input | | |
|---|---|---|
| Safety factor | 1.1 | |
| Fluid Thickness layer for lift | 0.01 | in |
| Fluid Viscosity | 20 | cp |
| Fluid Density | 9.5 | lb/gal |
| Radius of Port | 0.1 | in |

TABLE 1-continued

| HydroLift Design Computations | | |
|---|---|---|
| Radius of Lift | 1 | in |
| Lift Required | 350 | lbs |
| Diameter of Pipe | 5 | in |
| Length of Section | 10 | in |
| Eccentricity | 0.0625 | in |
| Diametrical Clearance | 0.012 | in |
| RPM | 120 | rpm |
| Coefficient of side leakage (n) | 0.77 | |
| Bearing Operation Characteristic (A) | 12 | |
| Angle between load and entering edge of mud | 50 | deg |
| Differential Pressure from Pump | 2000 | psid |
| Required Pump Capacity | 450 | gpm |
| Acceptable Pump Capacity Loss | 15 | % |
| Calculated Inputs | | |
| Number of Hydrolift required | 5 | |
| Fluid Density | 0.041 | lb/in^3 |
| Eccentricity Ratio (e) | 10.417 | Ratio of eccentricity to radial clearance |
| Diametrical Clearance Ratio (m) | 0.002 | Ratio of diametrical clearance/diameter |

Using the hydrolift design computation table recited above, the benefits of the hydrolift design are seen. For 9.5 lb/gal drilling mud operating the hydrolift protector on a 5 in. drill pipe and rotating at 120 rpm, the hydrolift protector provides approximately 350 lbs of lift, thus reducing the normal weight of the pipe at the sleeve and improving sliding. The benefits of improved lubrication improve sliding characteristics substantially.

The use of the reinforcement tubes effectively reduces the amount of material needed to construct the sleeve. Specifically, the protector shown in FIGS. 4 and 5 use approximately 35% less material than existing sleeve designs. FIG. 5 illustrates that the sleeve is approximately twice as long as prior existing sleeves, however, because of the reduced material used in the hydrolift protector, the sleeve is only 25% heavier but is 100% longer than conventional designs. The hydrolift protector can be made from various materials for different applications. For cased holes, the hydrolift protector could be a polymer material, using special low-friction polymers for open-hole designs, or the sleeve could be coated with a low-friction metal such amorphous titanium.

Configurations for the diffuser design balance the features of hydraulic lift of the pipe from the casing and the lubrication of the pipe to the casing. Because lift is provided by pressure, increasing the lift requires increasing the pressurized area. Typical hydraulic bearings produce pressure of 10–50 psi per inch of length for the range of typical pipe diameters. Thus, if the hydrolift diffuser has a normal area to the pipe of 0.1 sq. in. and the pressure is 40 psi, the lifting force is 4 pounds. If the area of the diffuser is increased to 1 in and the pressure remain constant, the lifting force is 40 lbs. per diffuser. Since a joint of 5-in. drill pipe typically weights approximately 660 lbs., then a hydrolift protector with 15 diffusers could effectively reduce the drill string drag observed at the rig floor.

This is of substantial importance to drilling operations. Because the normal force resulting from the pipe weight that produces the wear on the pipe on the casing, the effective weight reduction facilitates sliding in and out of the hole. The hydrolift protector provides the lift at exactly the point where it is required thus maximizing the benefits received.

The second factor of consideration for the hydrolift diffuser is lubrication. The result of improved lubrication and lift is to allow the hydrolift protector to act as a hydraulic bearing with resulting improved sliding friction. Typically protectors have a sliding friction that is dependent upon the coefficient of friction between the protector and the casing or formation. For steel casing and rubber traditional protectors, the coefficient of friction is between 0.25–0.35. The hydrolift protector of the present invention provides a lubrication film and hydraulic lift which results in a coefficient of friction of 0.05–0.1. The result is that ease of sliding into the hole is achieved. As drill string rpm increases, the lubrication benefit and the lifting benefit become more pronounced.

An associated benefit in the hydrolift protector design is hole cleaning. Typically in ERD wells as the build angle exceeds 55–60° cuttings have a tendency to settle out and fall to the low side of the casing. The result is cuttings dams and many associated problems. The hydrolift protector design allows the pressurized fluid to wash away the dams from the bottom of the casing and back into the fluid stream. Thus three benefits of the hydrolift protector are provided being lift, lubrication, and hole cleaning.

Wedgelift Type Drill Pipe Protector

Referring now to FIGS. 7–12 a wedgelift type non-rotating drill pipe protector is shown in various views and embodiments.

Figure 7:
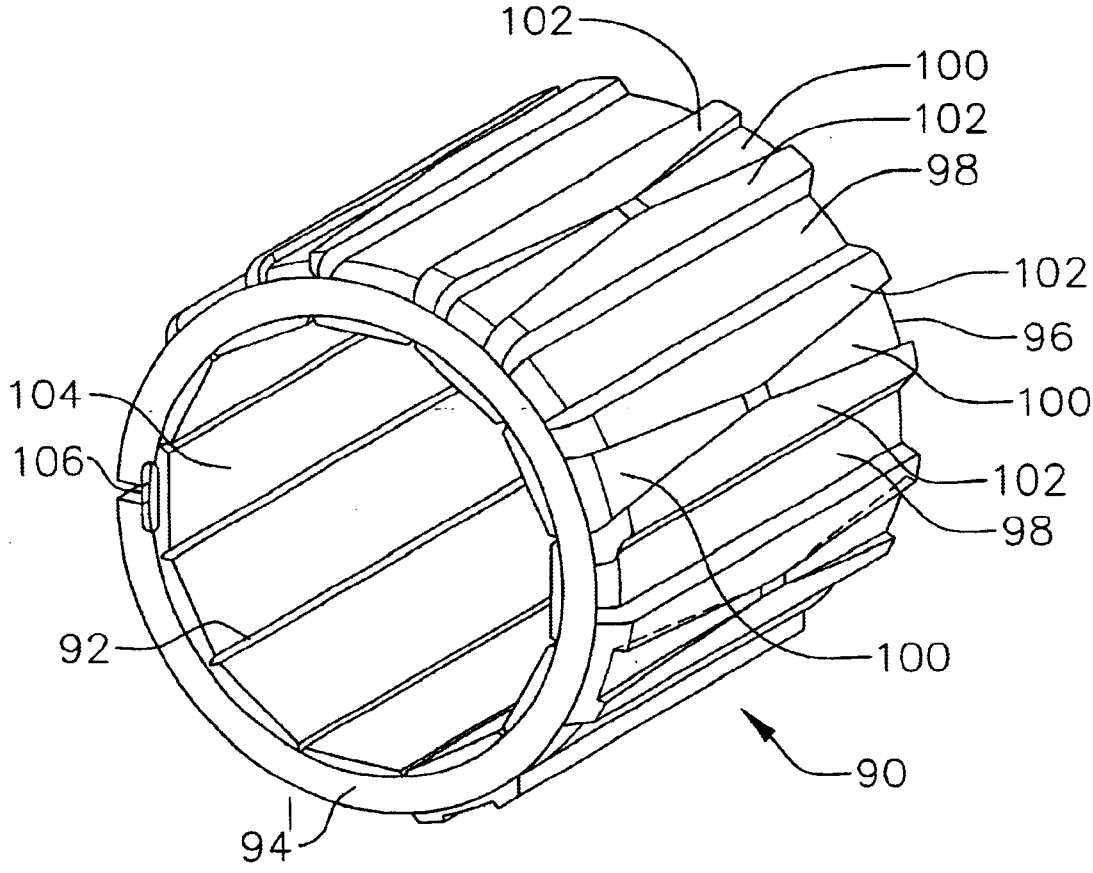
FIG. 7 is a perspective view of a wedgelift type drill pipe protector constructed according to the principles of the present invention.

FIG. 7 illustrates a wedgelift drill pipe protector 90 which preferably comprises an elongated tubular sleeve made from a suitable protective material, such as, a low coefficient of friction, polymeric material, metal or rubber material. A presently preferred material is a high density polyurethane or rubber material. The sleeve has an inside diameter having a plurality of elongated, longitudinally extending, straight, parallel axial grooves 92 spaced apart circumferentially around the I.D. of the sleeve. The grooves are preferably spaced uniformly around the I.D. of the sleeve, extend vertically, and are open-ended in the sense that they open to an annular first end 94 and an opposite annular second end 96 of the sleeve.

The inside wall of the sleeve is divided into intervening wall sections of substantially uniform width extending parallel to one another between adjacent pairs of grooves 92. Each wall section has an inside bearing surface which can be a curved or a flat surface.

The wall thickness of the sleeve is such that the drill pipe protector 90 has an O.D. greater than the O.D. of the adjacent drill pipe tool joints. The O.D. of the sleeve includes a plurality of circumferentially spaced apart longitudinally extending, parallel outer flutes 98 extending from end to end of the sleeve. The flutes are substantially wider than the grooves 92 inside the sleeve. Positioned between adjacent flutes 98 are wedge shaped channels 100. Intervening outer wall sections 102 formed by the O.D. wall of the sleeve between the flutes and the wedge shaped channels form wide parallel outer ribs with curved outer surfaces along the outside of the sleeve.

The wedge shaped channels provide hydraulic lift and improved sliding lubrication reducing the effective coefficient of friction between the drill pipe and the casing and increase the proclivity to slide down the hole. The wedge shaped channel located on the outer periphery of the sleeve generates a hydraulic bearing between the sleeve and the casing. Drilling mud is directed to the wedge shaped channels by the ribs of the outer wall sections 102 into the increasingly narrower and shallower wedge shaped channel. The outer ridges provide the dual function of directing the fluid flow and providing appropriate support for the drill string when at rest. The width, height and depth of the channel and outer ribs can be varied based upon the amount of deformation of the tool under resting loads. The design of the wedge shaped channel and outer ribs can be adjusted to the required size of pressurized region and expected loads by varying the width, depth, length and taper of the channel. The fluid tends to move into the narrowing channel resulting in a region with elevated pressure, thus lifting and lubricating the region between the protector sleeve and the casing wall. Multiple wedge shaped channel configurations can be placed on the same tool in various configurations such as more than one along the same line, along multiple parallel lines or along single or multiple spiral lines.

The wedge shaped channels 100 can be placed in a back-to-back configuration as shown in FIG. 7 thus allow the fluid movement through the channels facing the direction of movement and allowing drill cuttings to exit from the back side of the sleeve. In addition placing the wedge shaped channels in a back-to-back configuration allows reversibility of the tool.

The momentum of sliding into the hole actually helps to continue the sliding. This is of substantial importance to drilling operations considering the normal force resulting from frictional drag resistance of the pipe becomes increasingly greater at greater depths thus making tripping into and out of the hole increasingly difficult. Improved lubrication and lift allows the wedgelift protector to act as a hydraulic bearing with resulting improved sliding friction. For steel casing and traditional rubber protectors, the coefficient of friction is between 0.25–0.35. The wedgelift protector provides a lubrication film and hydraulic lift thereby reducing the coefficient of friction to between 0.05–0.1. Another benefit of the wedgelift protector is hole cleaning as previously discussed with respect to the hydrolift protector.

Referring again to FIG. 7 the wedgelift protector 90 is split longitudinally to provide a means for spreading apart opposite sides of the sleeve when mounting the sleeve to the O.D. of the drill pipe. The sleeve is split longitudinally along one edge 104 which is fastened by a latch pin 106 as is typical in the art. In this version, the sleeve is simply spread apart along the edge 104 when installed. Alternatively, the sleeve halves may be hinged along one side and releasably fastened on an opposite side by a latch pin or they may be secured along both opposite sides by bolts. A metal cage (not shown) forms an annular reinforcing ring embedded in the molded body of the sleeve as discussed above.

Top and bottom thrust bearings 22 and 24 as described in FIG. 2 maintain the protector 90 along the length of the drill pipe.

Figure 8:
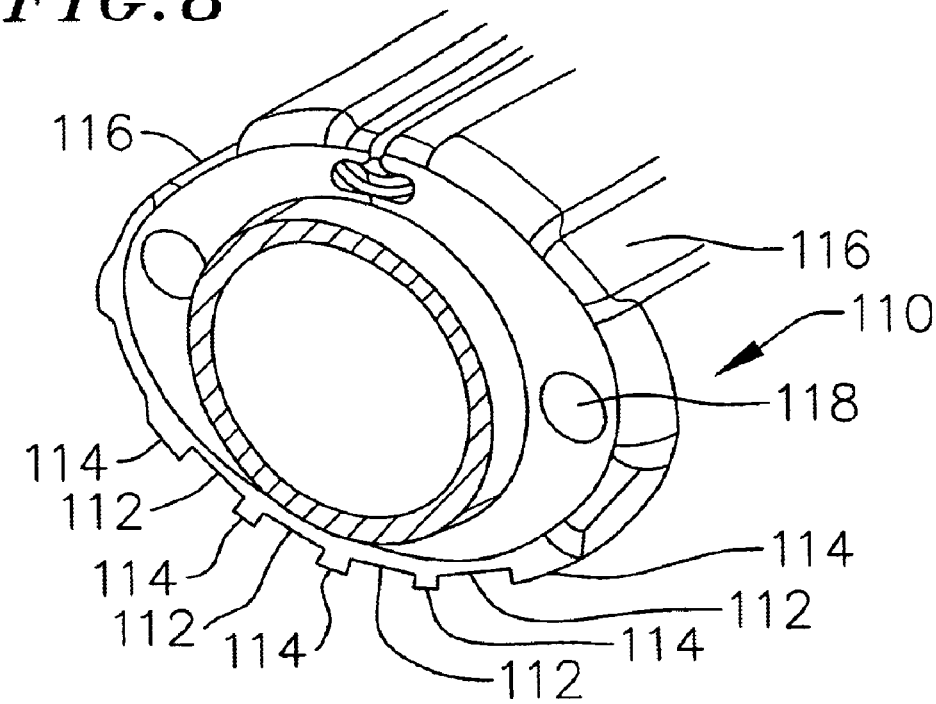
FIG. 8 is a partial perspective view of a first alternative wedgelift type drill pipe protector shown mounted over a section of drill pipe.

An alternative wedgelift protector 110 is shown in FIG. 8. In this embodiment the O.D. of the protector is "egg" shaped wherein the wedge shaped channels 112 are positioned on the bottom surface of the protector. The wedge shaped channels are separated by outer ribs 114. Flutes 116 are positioned on the top surface of protector 110. The egg shaped protector configuration allows the non-rotating protector to orient the wedgelift channels on the bottom of the hole thus properly orienting the protector within the casing. The protector 110 may also include flow channels 118 to assist in the return of drilling mud to the annulus between the protector and the casing.

Figure 9:
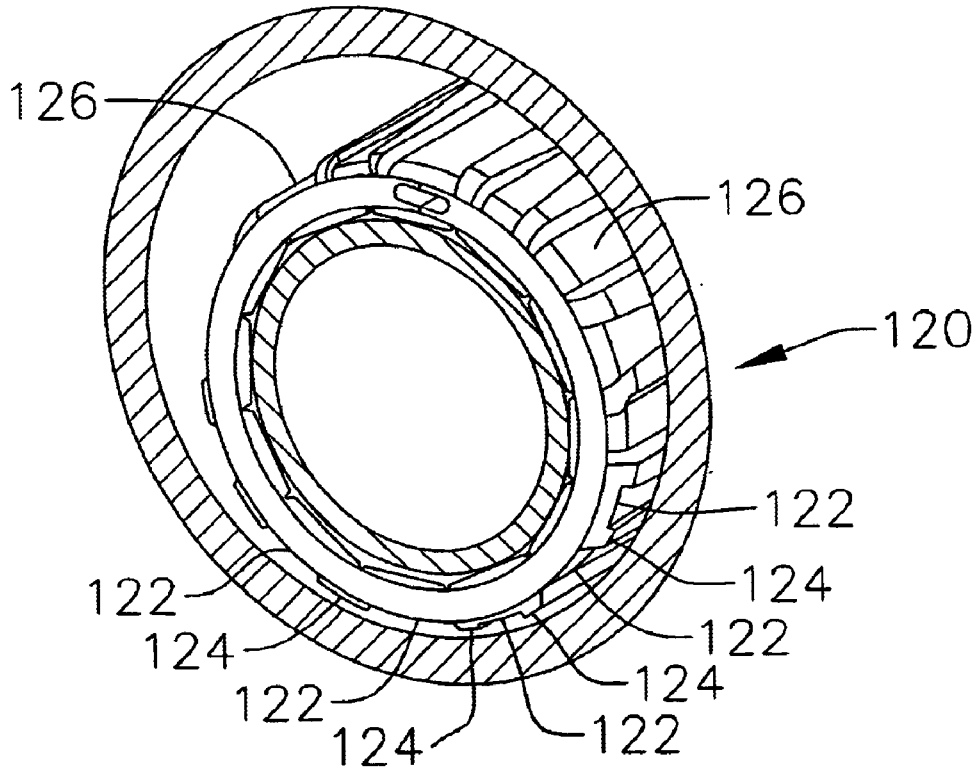
FIG. 9 is a partial perspective view of a second alternative embodiment of a wedgelift type drill pipe protector shown mounted over a section of drill pipe and positioned in a section of casing.

FIG. 9 illustrates a second alternative embodiment for the wedgelift protector 120 having an eccentric configuration. As with the embodiment shown in FIG. 9 the wedge shaped channels 122 are positioned on the bottom of the protector and are separated by ribs 124. Flutes 126 are positioned on the upper surface of the protector. In this eccentric configuration the wall thickness is thinner at the bottom where the wedge shaped channels are located than at the top where the flutes are located. In this configuration the design tends to force the wedge shaped channels onto the bottom of the hole thus properly orienting the protector.

Figure 10:
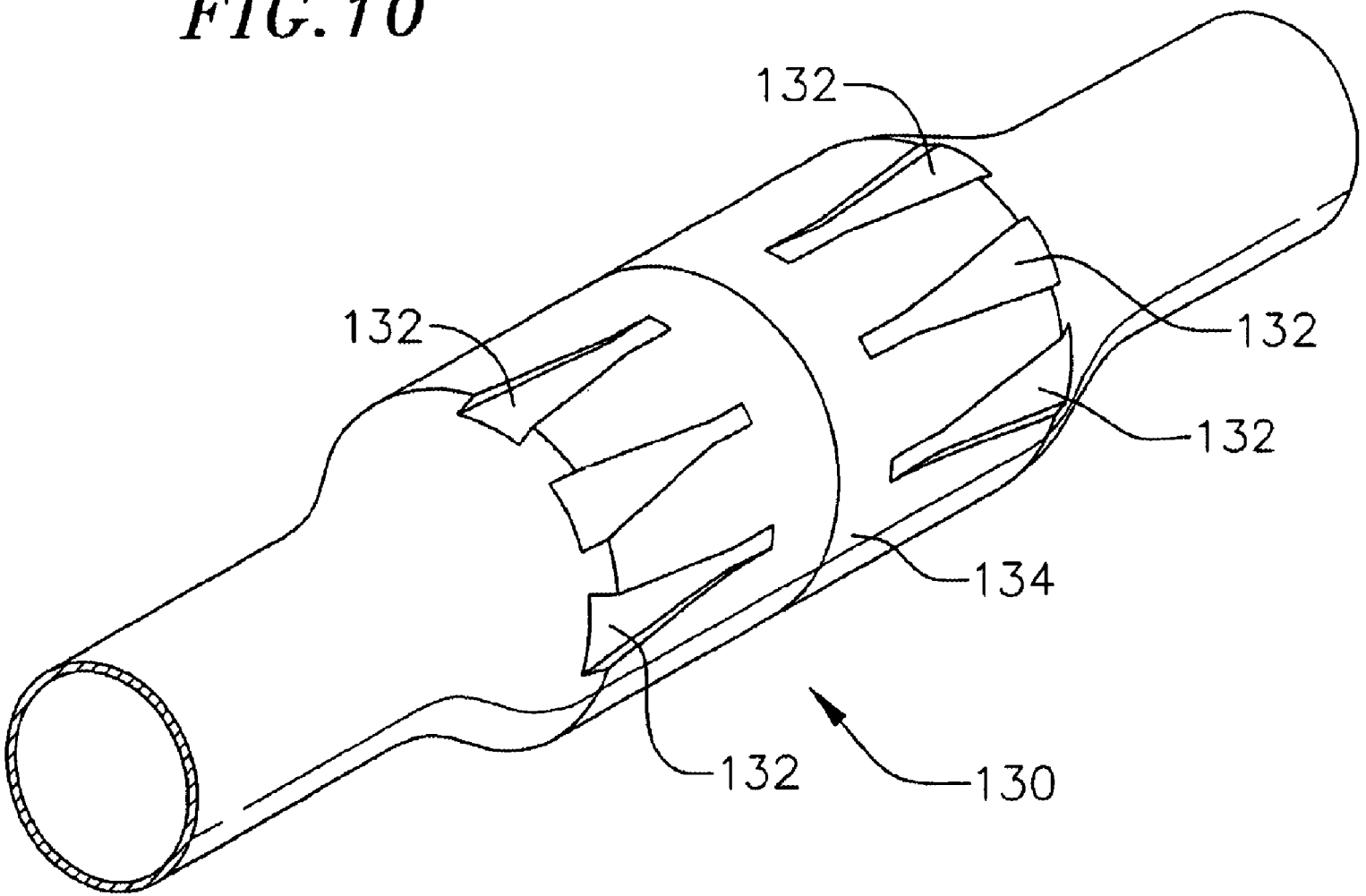
FIG. 10 is a perspective view of a drill pipe tool joint constructed according to the principles of the present invention and showing the wedgelift configuration on the external surface.

FIG. 10 illustrates the wedgelift concept as incorporated into the drill pipe tool joint 130. In this embodiment the wedge shaped channels 132 are milled into a drill pipe tool joint 134. The wedgelift configuration could be applied to virtually any type of down hole tool that needs assistance in sliding such as rotating drill pipe protectors, or integral to drill collars, stabilizers, drill pipe, or other down hole tools.

Figure 11:
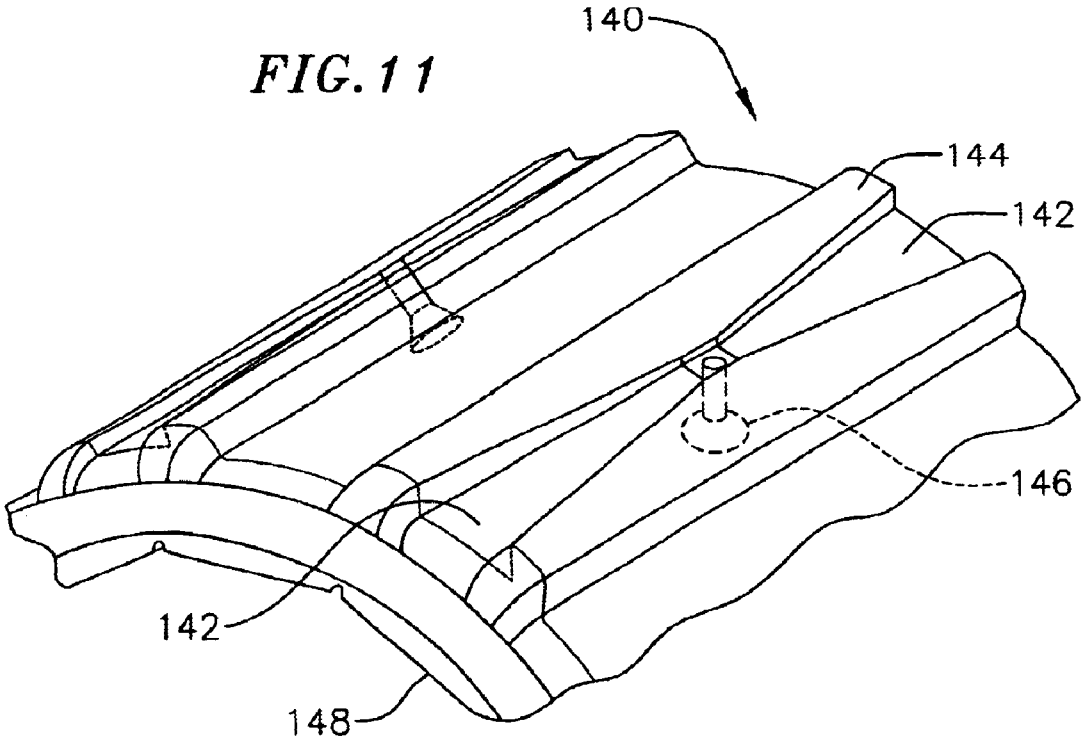
FIG. 11 is a partial perspective view of a drill pipe protector constructed according to the principles of the present invention and showing a hydrolift type opening and a wedgelift configuration on the external surface.
Figure 12:
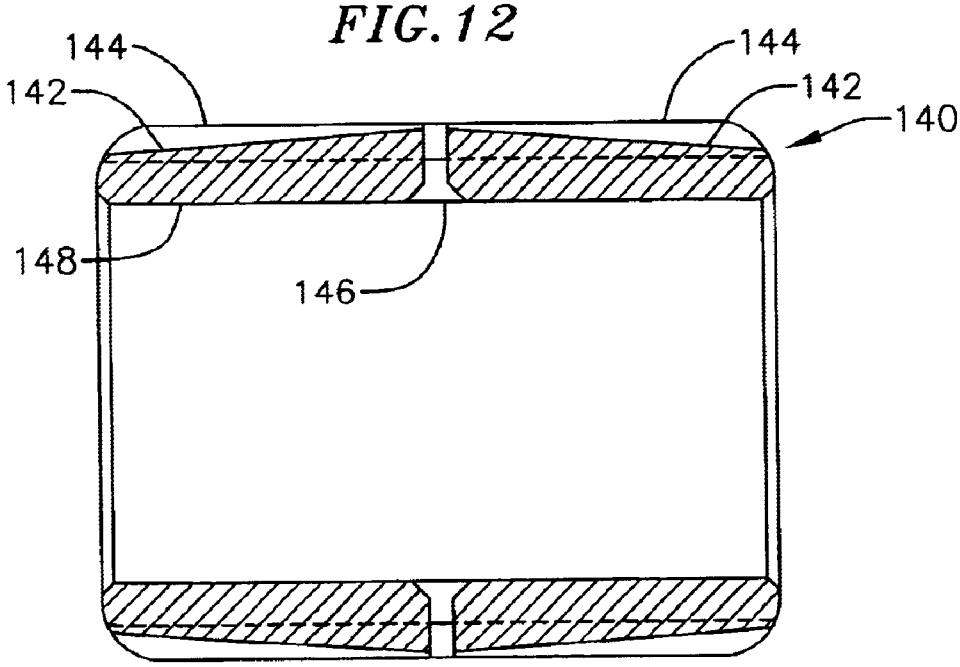
FIG. 12 is a side cross sectional view of the drill pipe protector assembly of FIG. 10 showing the hydrolift ports and the wedgelift channels on the external surface.

FIGS. 11 and 12 show yet another embodiment of the present invention incorporating both the wedgelift and hydrolift concepts. The protector 140 is similar to the protector shown in FIG. 7 which includes a plurality of wedge shaped channels 142 separated by ribs 144 on the O.D. of the drill pipe protector. The protector also includes a hydrolift exit port 146 extending from the I.D. 148 of the protector to the wedge shaped channels. Protector 140 is particularly useful in connection with starting of sliding of the drill pipe down the hole. As static is typically greater than the sliding friction, it can be difficult to start the sliding of the drill string after stopping to make or break a drill pipe joint (or stand). If the rig has the capability to rotate as well as lower or raise the pipe, as is frequently the case with rigs with top drive systems, then rotating the drill pipe will pump pressurized fluid from the I.D. of the sleeve to the O.D. of the protector. This pressurized fluid would enter the wedgelift configuration at its center, providing pressurized lubrication at the exact point of contact. The combination of fresh and pressurized lubrication would assist the overcoming of the static friction and assist the function of the wedgelift in the remainder of the movement of the drill pipe.

Multi-Sided Low-Friction Slip-Surface Non-Rotating Drill Pipe Protector

Figure 13:
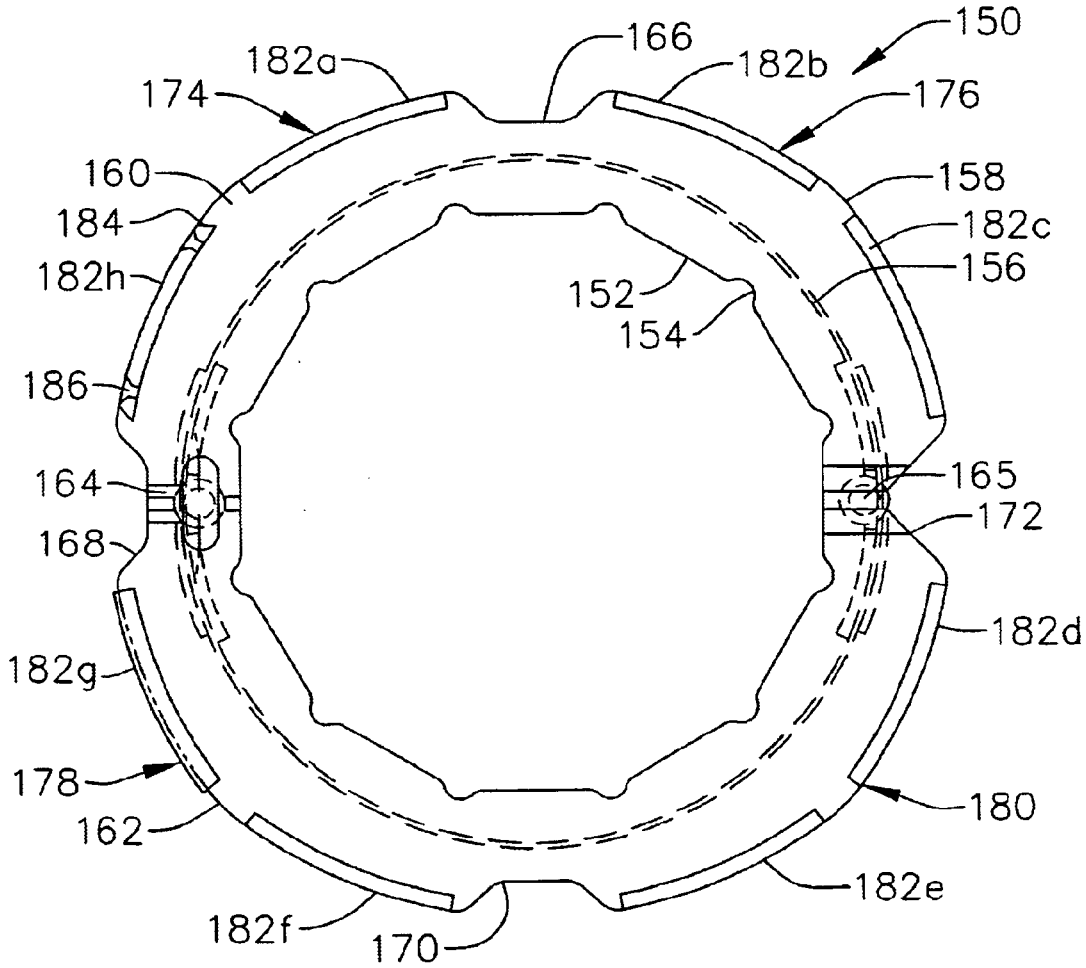
FIG. 13 is a cross-sectional view of a four-sided low-friction non-rotating drill pipe protector of the present invention.

Referring now to FIGS. 13–19, multi-sided low-friction slip-surface non-rotating drill pipe protectors are illustrated. FIG. 13 illustrates a four-sided low-friction non-rotating drill pipe protector 150. As with all the multi-sided low-friction slip-surface non-rotating drill pipe protectors, protector 150 comprises an elongated tubular sleeve made from a suitable protective material, such as a low coefficient of friction, polymeric material, metal or rubber material. A presently preferred material is a high density polyurethane having a metal reinforcing cage as previously discussed. Other materials can be a cage-reinforced rubber of various types including NBR (Nitrile Butadiene Rubber, hydrogenerated or nonhydrogenated), Aflas (fluorethylene rubber), with and without additives to improve performance, in addition to various other types of thermally and chemically stable plastics may be used. Protector 150 has an inside diameter in a generally polygonal or a curved shaped configuration. The I.D. wall 152 includes a plurality of elongated, longitudinally extending, straight, parallel axial grooves 154. The grooves are preferably spaced uniformly around the I.D. of the sleeve and extend vertically from end to end of the sleeve. The metal reinforcing cage 156 is embedded between the I.D. wall 152 and the O.D. wall 158.

Protector 150 includes a first section 160 and a second section 162 connected by a hinge 164 at one end and a latch pin 165 at an end opposite from the hinge 164. Four spaced apart flutes 166, 168, 170 and 172 are spaced around the perimeter and located on the O.D. wall 158 of the protector.

Unlike conventional drill pipe protectors that typically have an external radius that is approximately circular with respect to the drill pipe, protector 150 includes an outer surface having four distinct curves that are designed to contour the common casing size, thus increasing sliding contact surface area. Each section 160 and 162 includes two sides 174 and 176, and 178 and 180, respectively. By having multiple high radius external curved surfaces allows more even distribution of the weight of the drill string through the protector's sliding surfaces. A more uniform weight distribution results in more uniform friction along the sleeve. Each of the four sides 174–180 includes low coefficient of friction inserts 182*a–h* positioned on the wear areas of the sides. The low coefficient of friction inserts preferably include the use of a base material of polyurethane with Teflon bonded to its exterior. Other Teflon composites, coated aluminum or other low-friction material also could be used as the insert material. The inserts may be attached by an adhesive after the sleeve body is molded or inserted during the molding process. The inserts may contain beveled edges 184 or holes 186 to create a mechanical bond with the sleeve body. The inserts can be flush with the O.D. of the protector or can be raised 0.02–0.03 inches as shown with insert 182*g* to assist in wiping of the casing during operation and extend wear life.

More preferably the low coefficient friction inserts are made from a bronze impregnated Teflon (trade name Rulon 142) having a coefficient of friction of 0.10–0.12 against steel casing in drilling mud. As previously discussed the inserts may be held in place with high-strength high temperature adhesive, by molding into the urethane, mechanical bonds in the shape of rivets, or by mechanically connecting the inserts to the metal reinforcement cage. Preferably the inserts are bonded to the protector as strips with a typical thickness of 0.090 inches. The surfaces of the inserts are typically beveled to allow smooth transition between the inserts and the O.D. wall of the protector. A suitable adhesive is Tristar TCE211 which has suitable mechanical bonding strength at elevated temperatures. The Rulon inserts may be reinforced with an aluminum backing plate that facilitate manufacture and operations.

An advantage of using bronze impregnated Teflon as the inserts or other similar material such as glass or graphite filled Teflon is that the inserts will actually reduce the coefficient of friction in the casing. As the inserts wear against the casing, they leave small deposits of bronze impregnated Teflon in the casing. Therefore, as more and more protectors slide over a particular torturous portion of the casing, the surface becomes impregnated into the casing and tends to reduce the coefficient of friction of subsequent protectors that slide over the region. The use of Teflon as the inserts also demonstrates the lowest coefficient of friction on dry or nearly dry surfaces. In instances when the slide loads on the protector are so significant that the protector wipes the side of the casing, the Teflon inserts reduces encroachment of the drilling mud and reduces the coefficient of friction between the protector and the casing.

Figure 14:
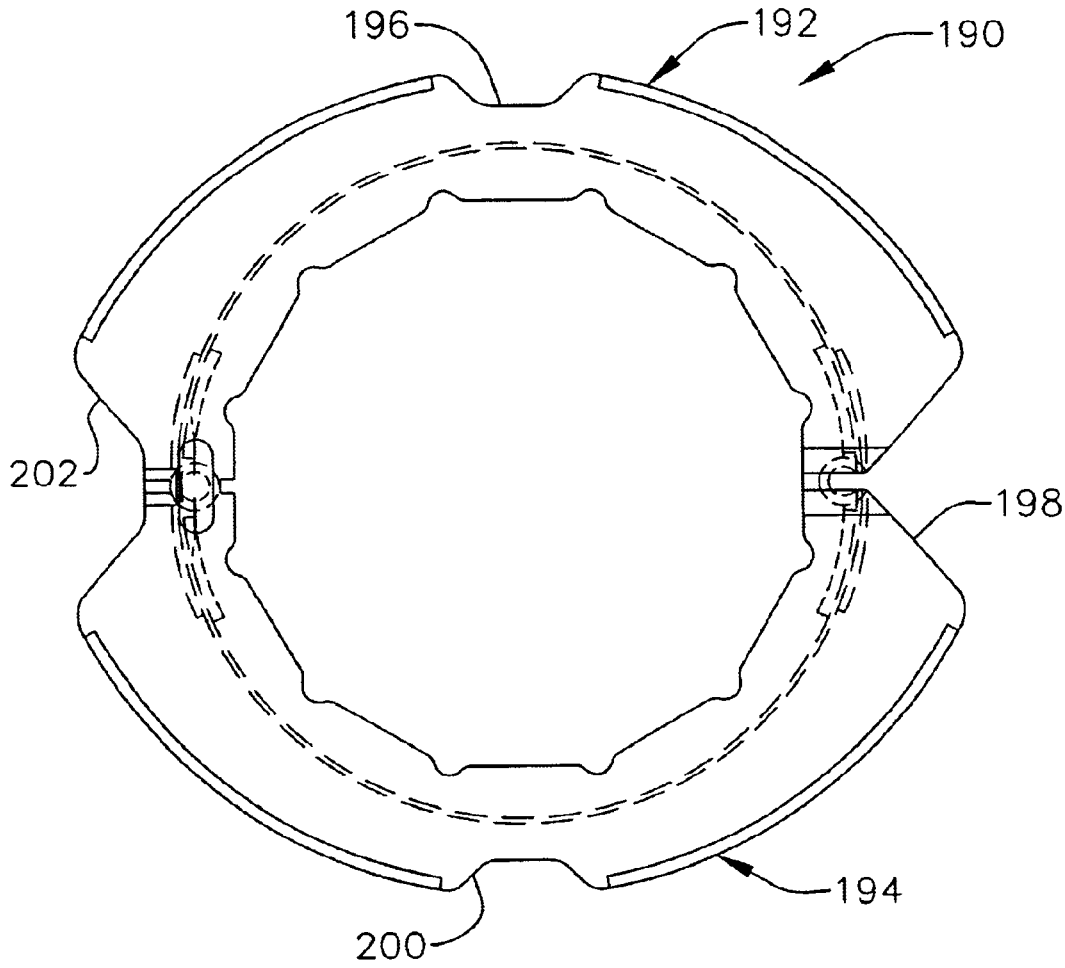
FIG. 14 is a cross-sectional view of a two-sided low-friction non-rotating drill pipe protector of the present invention.

FIG. 14 illustrates an alternative low-friction non-rotating drill pipe protector 190 having a two-sided 192 and 194 low-friction slip-surface configuration. Protector 190 includes 4 axial flutes 196, 198, 200 and 202. Although the protector 190 is illustrated with four axial flutes, it is to be understood that other numbers of flutes such as 2, 6 or 8 are also possible combinations. The advantage of a two-sided low-friction non-rotating drill pipe protector is that two sides provide for greater wear surface to be in contact with the casing.

Figure 15:
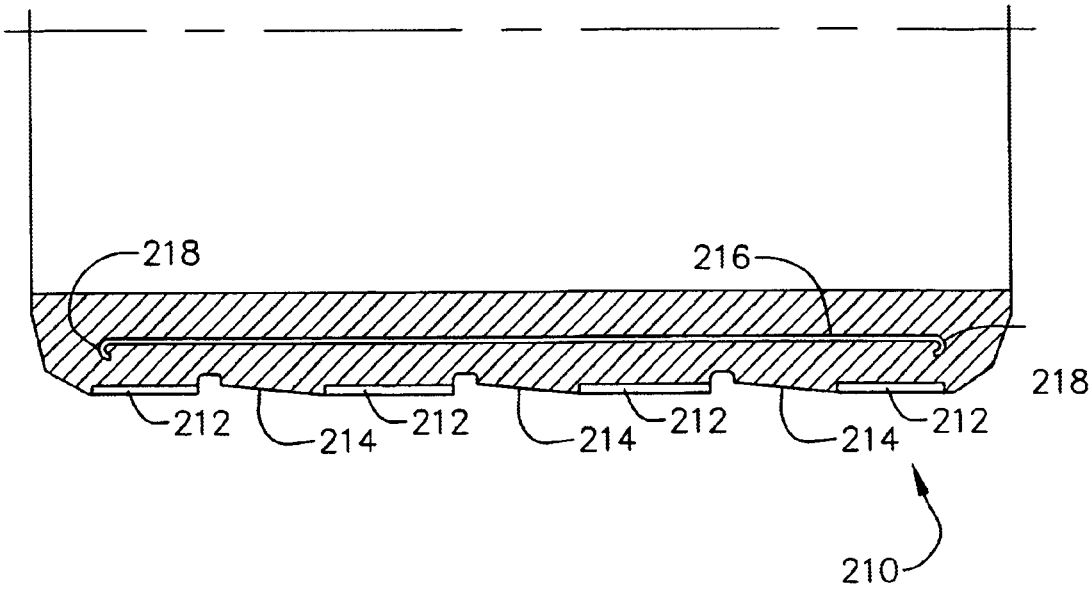
FIG. 15 is a partial cross section of a wedgelift type drill pipe protector incorporation low-friction pads.
Figure 16:
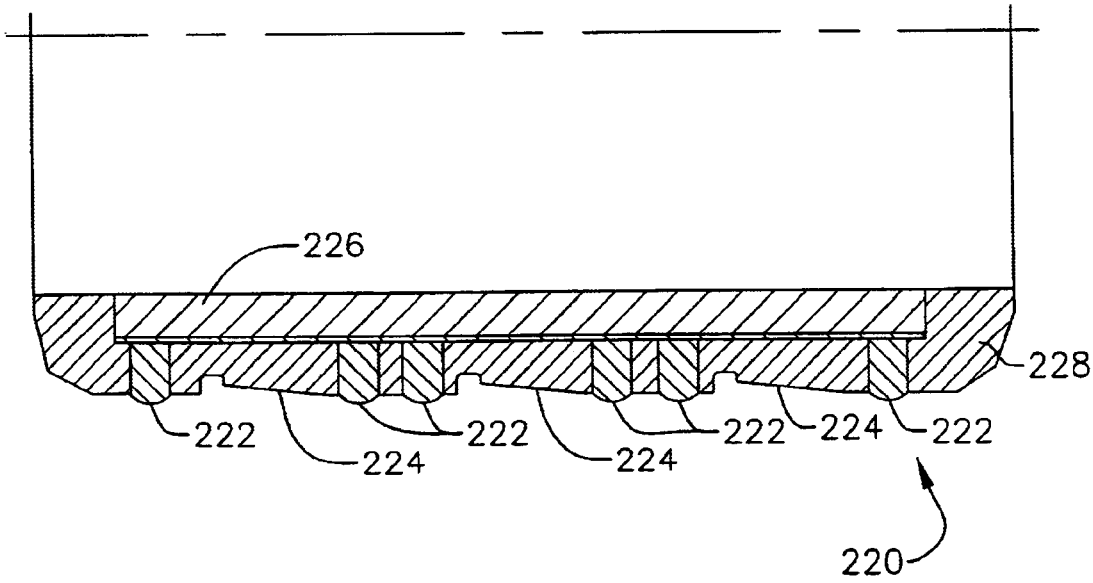
FIG. 16 is a partial cross section of a wedgelift type drill pipe protector incorporating low-friction studs.

FIGS. 15 and 16 illustrate the use of low coefficient of friction inserts in combination with the wedgelift protector previously discussed. FIG. 15 illustrates protector 210 having low coefficient of friction inserts 212 positioned adjacent the wedge shaped channels 214. Also shown in the reinforcement cage 216 embedded in the protector 210. The ends 218 of the cage 216 are curved over substantially (up to 200 degrees) by having multiple split sections around the circumference. The curved end sections allow better bonding between the sleeve material and the cage, which is especially useful in sleeves that are sliding within casing as better gripping between the cage and the protector material is achieved. Protector 220 shown in FIG. 16 illustrates the use of low coefficient of friction studs 222 positioned adjacent the wedge shaped channels 224. A plurality of aluminum studs with amphorous titanium coatings or other friction reducing coatings can be molded into the material or physically attached to the cage. The tips of the studs extend beyond the O.D. of the protector providing a multiplicity of extensions for the protector to slide upon. Extended tips can be placed in a variety of arrays that tend to maximize life and minimize potential damage to the casing. Alternatively, either bars or plates could be used with the coatings applied to produce long life low coefficient of friction surfaces. Other variations could include the use of continuous ribs or bars of aluminum or similar material instead of short studs. Use of bars has the advantage of longer surface area, thus fewer tendencies to damage the casing.

Multi-Component Non-Rotating Drill Pipe Protector

Also shown in FIG. 16 is an alternative materials configuration for the protector 220. The alternative materials configuration can be utilized for any configuration protector disclosed herein. Material 226 is a liner which is placed on the interior surface of the protector 220. Material 228 is placed on the exterior surface of the protector 220. Material 226 has relatively lower hardness (60 and less Shore A) than the exterior material 228 (90 Shore A). For example, material 226 is a soft elastomer or rubber having a Shore A hardness of 60 or less and material 228 is a urethane and has hardness of 95 Shore A. Material 226 and 228 may be the same material with different hardness or different materials, such as polyurethane with different hardnesses resulting from different amounts of plasticizer. Alternatively, the materials 226 and 228 may be substantially different such as Aluminum for material 228 and rubber for material 226 or a soft elastomer for material 226 and a polyurethane for material 228. Further material 228 can be a high-strength low-friction high-temperature plastic having a hardness of 75 to 123 Rockwell R. In this embodiment no metal reinforcing cage would be necessary wherein the material 228 would be injection molded and hinges (See FIG. 4) would be integrally formed. The material 228 can be molded as a hinged cylinder and have multiple distinct curved surfaces. One skilled in the art can see the wide range of material combinations that satisfy this design. The material 226 and material 228 may be chemically bonded, mechanically bonded, thermally bonded, or various combinations. The advantage of this design is that the interior material 226 is capable of flexing around debris caught between the protector 220 and the drill pipe without abrading the drill pipe substantially. The exterior material 228 with its greater hardness is more resistant to abrasion between the exterior of the protector 220 and the casing or borehole wall. Another advantage of having a softer elastomer for material 226 is a greater fluid bearing performance. The load carrying capacity of a 60 Shore A elastomer fluid bearing is at least twice that of a 95 Shore A elastomer fluid bearing of the same geometry. Friction is also significantly lower in softer 60 Shore A fluid bearings than in harder 95 Shore A fluid bearings.

A problem with a sleeve that utilizes a soft elastomer is that they have significantly lower strength, tear resistance, chemical resistance, and temperature resistance than harder elastomers. Therefore, a composite sleeve with materials 226 and 228 can obtain the optimum fluid bearing performance while maintaining high strength. Material 226 which would be approximately 0.125 to 0.250 inches thick inside material 228, the resulting combination provides a significant improvement in load carrying capacity and reduction in friction compared to single component designs in all operating conditions while maintaining or improving the strength and toughness of the overall design.

The soft elastomer material 226 would be formed with the polygonal geometry (i.e., axial grooves), as shown herein, which provides optimum pressure distribution across the fluid bearing surface because the surface deforms under the contact load to distribute the load of the rotating element and maintain fluid bearing hydrodynamic lift over a greater area. The fluid bearing performance is directly related to the area and pressure of the fluid bearing between the rotating drill pipe and the stationary sleeve. The softer elastomeric materials in the area of the fluid bearing greatly increases the fluid bearing capability of the sleeve and seen in more detail in FIGS. 17 and 18. Material 226 can be a one-piece liner or inserted as several pieces or strips on the I.D. of the sleeve and seen in more detail in FIGS. 17 and 18. Material 226 can extend from one end to the other of the sleeve or only extend through part of the length of the sleeve as shown in FIG. 16. When the elastomeric liner extends only partially through the length of the sleeve, it may be necessary to provide a tapered recess in the harder urethane body to prevent wear of the drill pipe over that region of the sleeve.

Non-Rotating Drill Pipe Protector With Low Friction End Pads

Figure 17:
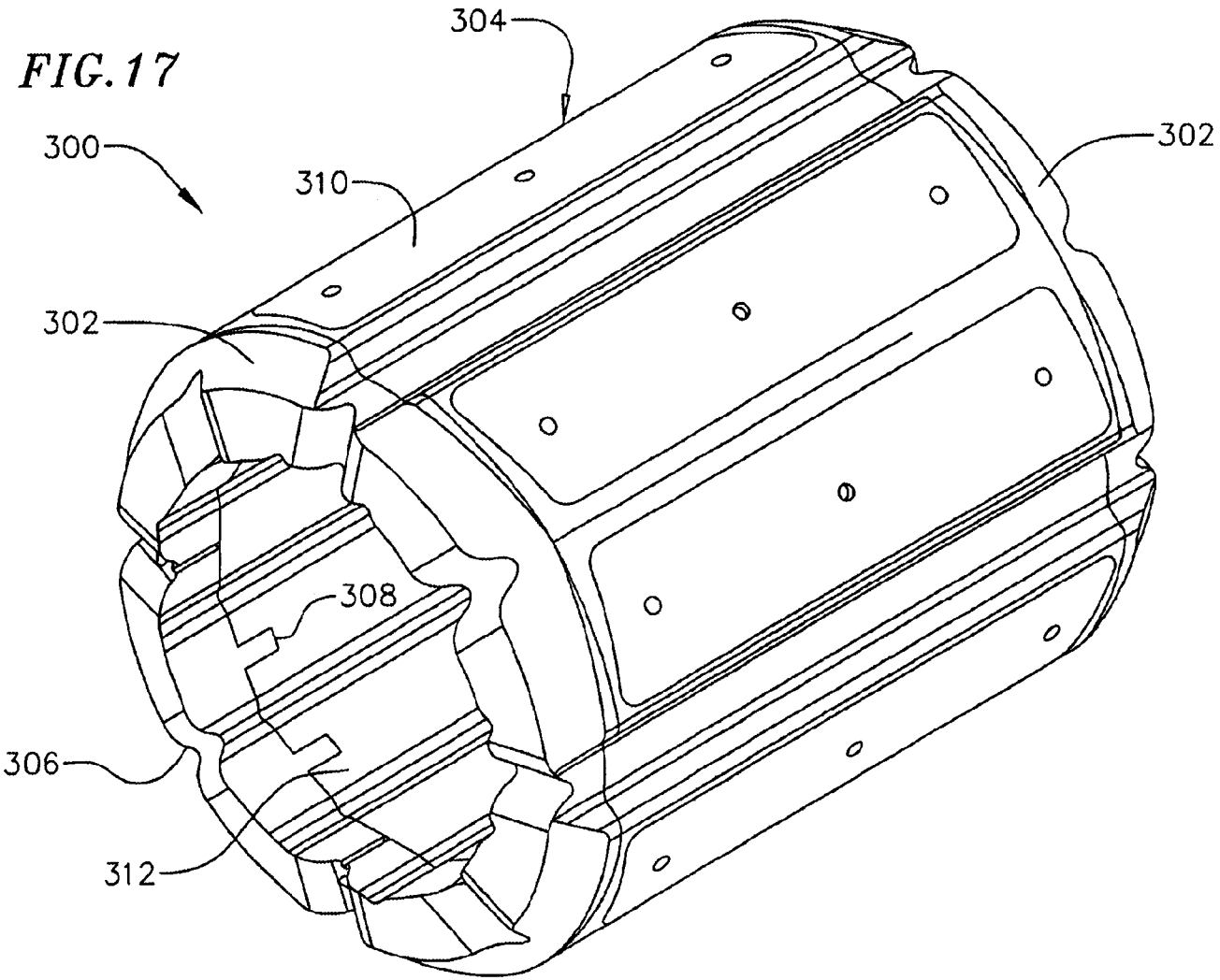
FIG. 17 is a perspective view of a drill pipe protector having single piece low-friction pads integrally molded into the protector with flexible multi-stave I.D. pads.

Quantification of the rotational frictional loss at the interface of the sleeve and the collar varies for different types of materials used for the sleeves. For urethane sleeves with 95 A Shore hardness, approximately 50 to 60% of the total frictional loss comes from the friction between the ends of the sleeve and the collar. The friction between the ends of the sleeve and the collar is the source for the wearing of the ends of the sleeves and, hence, most frequently becomes the factor that limits the useful economic life of sleeves and collars. Consequently, the present invention defines a sleeve configuration that reduces the friction at the sleeve/collar interface while also improving economic value through increased product life without loss of structural integrity. The present invention achieves this objective by providing a drill pipe protector 300, as shown in FIG. 17, which incorporates low-friction abrasion-resistant end pads 302 positioned on each end of the sleeve 304. Although the end pads 302 are shown in connection with sleeve 304, it is to be understood that low-friction abrasion-resistant end pads can be utilized in connection with any of the sleeve designs disclosed herein.

End pads 302 are a single piece that is integrally molded into the sleeve 304 during the manufacturing process. The end pads 302 are pre-stamped into the preferred configuration that includes castellations 306, which allow fluid to pass from the I.D. of the sleeve/drill pipe interface and over the end of the sleeve and collar interface, thus assisting with lubrication and cooling and reducing wear, as previously discussed herein. For use in connection with a polyurethane sleeve, during manufacturing the pre-formed low-friction end pad is placed at the bottom of the mold, and the inner cage (FIGS. 13 and 14) are placed in the mold on top of the end pad. The cage can prevent the flotation of the end pad during molding or can be mechanically attached to the cage by rivets, or other mechanical interlocking components commonly known in the art. Protector 300 can have only one low-friction end pad 302 positioned on the sleeve 304 or can have a second end pad added during the manufacturing process, resulting in an end pad positioned at either end of the sleeve 304. Factors, such as manufacturing cost, economic life, and application, can dictate whether one or two end pads are incorporated into the protector 300.

Figure 18:
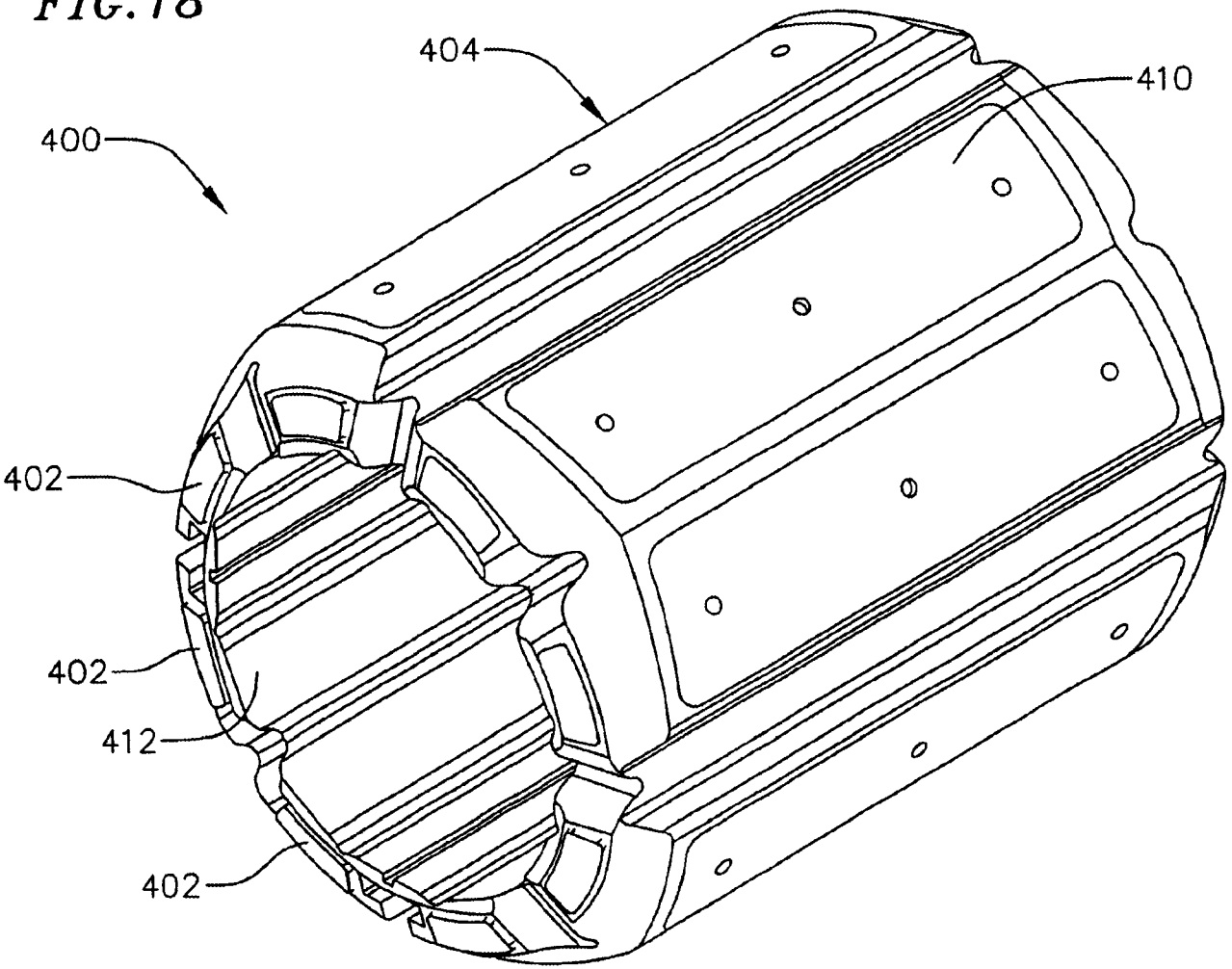
FIG. 18 is a perspective view of a drill pipe protector having multiple segments of low-friction end pads molded into the protector with flexible multi-stave I.D. pads.

FIG. 18 illustrates another embodiment protector 400 wherein multiple segments of low-friction abrasion-resistant end pads 402 are placed at the ends of the sleeve 404. In this configuration, instead of having a single integrally formed end pad, as shown in FIG. 17, multiple individual segments which together form the end pads would be placed at the bottom of the mold, and the polyurethane or other plastic would be poured around the pads to position it in the sleeve. For both embodiments shown in FIGS. 17 and 18, the preferred low-friction abrasion-resistant end pad material is an ultra high molecular weight polyethylene averaging 3.1 to 6 million molecular weight compliance with ASTM 4020-81 standards. This material is non-abrasive, has a low coefficient of friction less than 0.2, is 600% more abrasion-resistant than steel, has no notch-sensitivity or cold embrittlement (155F. to +200F.). The ultra high molecular weight polyethylene is available under various trade names, including Ultra Fend by UltraPoly Corporation.

Ultra-high molecular weight polyethylene is available in various shapes and sizes that can be utilized for the end pads of the sleeves. The material can be available as rings with the appropriate diameter of the sleeve, which then would be stamped to include the surface features of castellations 306, and the bottom surface that interfaces with the cage. The bottom surface can include flanges 308 to provide the mechanical locking feature with the cage and the poured polyurethane sleeve 304. Alternatively, the end pads for either embodiment may be stamped from flat sheets of material. By way of example, the sleeve shown in FIGS. 17 and 18 is made of polyurethane also having low-friction side pads 310 and 410, respectively, which could be made of Rulon or the ultra high molecular weight polyethylene material used for the end pads. The inside surface 312 and 412 can include a soft elastomer liner, as discussed with respect to FIG. 16. Similarly, any of the other features disclosed herein can be incorporated into the protector, such as hydrolift ports, wedgelift channels, or a plurality of curved surfaces around the outside diameter of the sleeve. Similarly, the sleeve can be made of rubber or metal, which incorporates the low-friction end pads.

Although the present invention has been discussed with various embodiments thereof, it is to be understood that it is not to be so limited since changes and modifications can be made which are within the full intended scope as hereinafter claimed.

What is claimed is:

1. An underground drilling system comprising:

a wellbore in an underground formation;

a fixed tubular casing installed in the wellbore;

a rotary drill pipe extending through the casing and having O.D. spaced from an I.D. of the casing or wellbore during normal drilling operations;

a protective sleeve mounted around the drill pipe and spaced from the I.D. of the casing or bore for preferentially contacting the I.D. of the casing or bore when the drill pipe deflects off-center in the casing or bore to protect the casing or bore from contact with the drill pipe or its tool joints during rotation of the drill pipe;

thrust bearing collars rigidly affixed to the drill pipe above and below the sleeve for maintaining the sleeve in a fixed axially position on the drill pipe;

the protective sleeve mounted to the drill pipe via an internal sleeve I.D. configuration that substantially reduces the rotational rate of the sleeve upon frictional contact of the sleeve with the I.D. of the casing or bore, while allowing the rotary drill pipe to continue rotating within the sleeve at a rotation rate sufficient to conduct drilling operations in the formation;

said internal configuration comprising longitudinally extending and circumferentially spaced apart axial grooves formed in an I.D. wall of the sleeve for allowing fluid to circulate through a space formed between the I.D. of the sleeve and the O.D. of the drill pipe;

at least one low-friction abrasion-resistant end pad formed on at least one end of the protector sleeve to reduce friction between the end of the protector sleeve and an adjacent end of the thrust bearing collar.

2. The drilling system of claim 1 wherein the sleeve has a low-friction abrasion-resistant end pad formed on either end of the protector sleeve.

3. The drilling system of claim 1 wherein the end pad is a single piece integrally formed with the sleeve.

4. The drilling system of claim 1 wherein the end pad comprises multiple segments formed in the end of the protector sleeve.

5. The drilling system of claim 1 wherein the end pad is made of ultra high molecular weight polyethylene.

6. The drilling system of claim 1 wherein the end pad is mechanically attached to the end of the protector sleeve.

7. The drilling system of claim 1 wherein the end pad has castellations formed around a perimeter of the end pad.

8. The drilling system of claim 1 wherein the end pad is attached to a cage embedded in the protector sleeve.

9. The drilling system of claim 1 wherein the protector sleeve has a soft elastomer liner on the I.D. of the protector sleeve.

10. The drilling system of claim 1 wherein the protector sleeve has an O.D. including multiple distinct radius external curved surfaces.

11. The drilling system of claim 1 wherein the O.D. of the protector sleeve includes at least one low-friction insert.

12. A protective sleeve for installation around a drill pipe used to drill a wellbore in an underground formation, the protective sleeve preferentially contacting the I.D. of a well casing or bore when the drill pipe deflects off center in the casing or bore to protect the casing or bore from contact with the drill pipe or its tool joints during rotation of the drill pipe, and which the sleeve has a generally cylindrical configuration with an internal I.D. for contact with the O.D. of the drill pipe wherein the sleeve is a multi-component construction comprising an outer shell and a liner positioned within the shell wherein the shell has a hardness greater than the liner.

13. A drill pipe protector for use in a wellbore comprising:

a substantially cylindrical sleeve sized to be placed around a drill pipe;

said sleeve having an I.D. having a plurality of grooves for generating a fluid bearing between the I.D. of the sleeve and the drill pipe;

the sleeve having a soft elastomer liner positioned on the I.D. of the sleeve; and at least one low-friction end pad formed on an end of the sleeve.

14. The protector of claim 13 wherein the sleeve has a low-friction end pad positioned on each end of the sleeve.

15. The protector of claim 13 wherein the end pad comprises multiple segments formed in the end of the sleeve.

16. The protector of claim 13 wherein the sleeve has an O.D. which includes low coefficient of friction wear pads on the surface of the O.D.

17. The protector of claim 13 wherein the sleeve has an O.D. which has a plurality of distinct radius curved surfaces.

18. The protector of claim 13 wherein the sleeve includes a reinforcement cage embedded in the sleeve to which the end pads are attached.

19. The protector of claim 13 wherein the end pad is made of ultra high molecular weight polyethylene.

20. A non-rotating drill pipe protector for use and the wellbore comprising:

a sleeve sized to be placed around a drill string;

said sleeve having an I.D. having a plurality of grooves for generating a fluid bearing between the I.D. and the drill pipe;

the sleeve having an O.D. including multiple distinct radius external curved surfaces contoured for increasing sliding contact surface area, said contoured surfaces separated by channels on the O.D.; and a soft elastomer liner on the I.D. of the sleeve.

21. The protector of claim 20 wherein the sleeve has at least one low-friction end pad positioned on the end of the sleeve.

22. The protector of claim 21 wherein the end pad comprises multiple segments formed in the end of the sleeve.

23. The protector of claim 21 wherein the sleeve has a low-friction end pad positioned on each end of the sleeve.

24. The protector of claim 20 wherein the sleeve has low-friction wear pads on the O.D. of the sleeve.

25. The protector of claim 23 further comprising a metal reinforcing cage imbedded within the sleeve between the O.D. and the I.D.

26. The protector of claim 25 wherein the end pads are fastened to the cage.

27. The protector of claim 24 wherein the wear pads are fastened to a reinforcing cage embedded within the sleeve.

28. The protector of claim 21 wherein the end pad is made of ultra high molecular weight polyethylene.

29. The drilling system of claim 9 wherein the liner comprises multiple strips positioned around the I.D. of the protector sleeve.

30. The drilling system of claim 10 wherein the O.D. of the sleeve includes at least one low coefficient of friction wear pad on the O.D.

31. The drilling system of claim 9 wherein the sleeve has a hard plastic outer shell in the range of 75 to 123 Rockwell R.

32. The protector of claim 13 wherein the liner comprises multiple strips positioned around the I.D. of the sleeve.

33. The protective sleeve of claim 12 wherein the shell has a hardness in the range of 75 to 123 Rockwell R.

34. The protector of claim 20 wherein the liner comprises multiple strips positioned around the I.D. of the sleeve.

35. The protective sleeve of claim 12 wherein the liner comprises multiple strips positioned around the I.D. of the shell.

36. A drill pipe protector for use in a wellbore comprising:

a substantially cylindrical sleeve sized to be placed around a drill pipe;

the sleeve having an I.D. having a plurality of grooves for generating a fluid bearing between the I.D. of the sleeve and the drill pipe;

the sleeve having a high-strength low-friction high-temperature plastic shell and a soft elastomer liner positioned within the shell; and at least one hinge formed on the shell.

37. The protector of claim 36 wherein the sleeve has an O.D. which has a plurality of distinct radius curved surfaces.

38. The protector of claim 36 wherein the liner comprises multiple strips positioned around the I.D. of the protector sleeve.

39. The protector of claim 36 wherein the shell has a hardness in the range of 75 Shore A to 123 Rockwell R.

40. The protector of claim 36 wherein the liner has a hardness of 60 Shore A or less.

* * * * *